US005666141A

United States Patent [19]

Matoba et al.

[11] Patent Number: 5,666,141

[45] Date of Patent: Sep. 9, 1997

[54] INK JET HEAD AND A METHOD OF MANUFACTURING THEREOF

[75] Inventors: Hirotsugu Matoba, Sakurai; Susumu Hirata, Ikoma; Yorishige Ishii, Yamatotakada; Tetsuya Inui, Nara; Kenji Ohta, Kitakatsuragi; Shingo Abe, Tenri; Zenjiro Yamashita, Yamato-koriyama, all of Japan

[73] Assignee: Sharp Kabushiki Kaisha, Osaka, Japan

[21] Appl. No.: 272,447

[22] Filed: Jul. 8, 1994

[30] Foreign Application Priority Data

| | | | |
|---|---|---|---|
| Jul. 13, 1993 | [JP] | Japan | 5-173421 |
| Nov. 8, 1993 | [JP] | Japan | 5-278271 |

[51] Int. Cl.[6] ..... B41J 2/045

[52] U.S. Cl. ..... 347/54; 347/68

[58] Field of Search ..... 347/20, 54, 68, 347/70, 71

[56] References Cited

U.S. PATENT DOCUMENTS

| | | | |
|---|---|---|---|
| 4,032,929 | 6/1977 | Fischbeck | 347/68 X |
| 4,539,575 | 9/1985 | Nilsson | 347/68 |
| 4,605,167 | 8/1986 | Maehara | 347/68 X |
| 4,825,227 | 4/1989 | Fischbeck | 347/69 |
| 4,998,120 | 3/1991 | Koto et al. | 347/70 |

FOREIGN PATENT DOCUMENTS

| | | | |
|---|---|---|---|
| 0608835 A2 | 8/1994 | European Pat. Off. | B41J 2/045 |
| 356-025464 | 3/1981 | Japan | B41J 3/04 |
| 63-297052 | 12/1988 | Japan . | |
| 1-267047 | 10/1989 | Japan | B41J 3/04 |
| 2-30543 | 1/1990 | Japan . | |
| 2-219654 | 9/1990 | Japan | B41J 2/045 |
| 404-001051 | 1/1992 | Japan | B41J 2/045 |
| 4-52144 | 2/1992 | Japan | B41J 2/16 |

OTHER PUBLICATIONS

Variable Volume Electromagnetically–Actuated Valued Liquid Print Head For Directly Writing on Paper; IBM Tec. Disc. Bulletin, vol. 30, No. 11 Apr. 1988, pp. 66–68.

Patent Abstracts of Japan, vol. 016, No. 416 (M–1304), 2 Sep. 1992 & JP–A–04 141429 (Seiko Epson Corp) 14 May 1992.

Patent Abstracts of Japan, vol. 016, No. 135 (M–1230), 6 Apr. 1992 & JP–A–03 295655 (Seiko Epson Corp) 26 Dec. 1991.

Patent Abstracts of Japan, vol. 005, No. 076 (M–069), 20 May 1981 & JP–A–56 025464 (Canon Inc) 11 Mar. 1981.

Patent Abstracts of Japan, vol. 014, No. 323 (M–0997), 11 Jul. 1990 & JP–A–02 108544 (Seiko Epson Corp) 20 Apr. 1990.

Patent Abstracts of Japan, vol. 016, No. 149 (M–1234), 13 Apr. 1992 & JP–A–04 005051 (Seiko Epson Corp) 9 Jan. 1992.

Patent Abstracts of Japan, vol. 016, No. 503 (M–1326), 16 Oct. 1992 & JP–A–04 185348 (Seiko Epson Corp) 2 Jul. 1992.

Patent Abstracts of Japan, vol. 016, No. 137 (M–1231), 7 Apr. 1992 & JP–A–03 297653 (Seiko Epson Corp) 27 Dec. 1991.

*Primary Examiner*—Joseph W. Hartary
*Attorney, Agent, or Firm*—Nixon & Vanderhye P.C.

[57] ABSTRACT

A casing and a nozzle plate form a hollow cavity in which ink liquid can be filled. A buckling structure body is disposed within this hollow cavity. A nozzle orifice is provided in a nozzle plate at a position corresponding to the buckling structure body. The buckling structure body has a portion extending in a longitudinal direction. Both ends of the buckling structure body in the longitudinal direction are fixedly attached to the casing via an insulative member. The buckling structure body is formed of a material that is displaced at least in the longitudinal direction by conduction of current from a power source. Thus, an ink jet head of a long lifetime is provided that can provide a great discharge force while maintaining its small dimension.

13 Claims, 38 Drawing Sheets

BUCKLING STRUCTURE BODY TEMPERATURE (°C)
250
200
150
100
50
225°C
98°C
Tr= 28μ
Id = 123μ sec
0
50
100
150
200
TIME T (μsec)

POWER (W)
5
4
3
2
1
0
4.676
0
28
50
100
150
200
TIME T (μsec)

INK JET HEAD AND A METHOD OF MANUFACTURING THEREOF

BACKGROUND OF THE INVENTION

1. Field of the Invention

The present invention relates to an ink jet head and a method of manufacturing thereof, and more particularly to an ink jet head for discharging ink droplets outwards from the interior of a vessel by applying pressure to the ink liquid in the vessel, and a method of manufacturing thereof.

2. Description of the Background Art

An ink jet method of recording by discharging and spraying out a recording liquid is known. This method offers various advantages such as high speed printing with low noise, reduction of the device in size, and facilitation of color recording. Such an ink jet recording method carries out recording using an ink jet record head according to various droplet discharging systems. For example, droplet discharge means includes an ink jet head utilizing pressure by displacement of a piezoelectric element, and a bubble type ink jet head.

Layered type and bimorph type ink jet heads are known as droplet discharging means utilizing a piezoelectric element. A layered type ink jet head and a bimorph type ink jet head will be described hereinafter with reference to the drawings as conventional first and second ink jet heads.

FIG. 52 schematically shows a sectional view of the structure of a first conventional ink jet head. Referring to FIG. 52, a first conventional ink jet head 310 utilizes layered type piezoelectric elements as the droplet discharging means. Ink jet head 310 includes a vessel 305 and a layered type piezoelectric element 304.

Vessel 305 includes a cavity 305*a*, a nozzle orifice 305*b*, and an ink feed inlet 305*c*. Cavity 305*a* in vessel 305 can be filled with ink 80. Ink 80 can be supplied via ink feed inlet 305*c*. Nozzle orifice 305*b* is provided at the wall of vessel 305. Cavity 305*a* communicates with the outside world of vessel 305 via nozzle orifice 305*b*. A layered type piezoelectric element 304 is provided in cavity 305*a*. Layered type piezoelectric element 304 includes a plurality of piezoelectric elements 301 and a pair of electrodes 303. The plurality of piezoelectric elements 301 are layered. The pair of electrodes 303 are arranged alternately to be sandwiched between respective piezoelectric elements 301, whereby voltage can be applied effectively to each piezoelectric element 301. A power source 307 is connected to the pair of electrodes 303 to switch the application of voltage by turning ON/OFF a switch.

According to an operation of ink jet head 301, the switch is turned on, whereby voltage is applied to the pair of electrodes 303. As a result, voltage is applied to each of the plurality of piezoelectric elements, whereby each piezoelectric element 301 extends in a longitudinal direction (the direction of arrow $A_1$). Ink jet head 310 of FIG. 53 shows the state where each piezoelectric element 301 extends in the longitudinal direction.

The expansion of each piezoelectric element 301 in the longitudinal direction (in the direction of arrow $A_1$) causes pressure to be applied to ink 80 in cavity 305*a*. Pressure is applied to ink 80 in the direction of arrows $A_2$ and $A_3$, for example. By the pressure in the direction of arrow $A_2$ particularly, ink 80 is discharged outwards via nozzle orifice 305*b* to form an ink droplet 80*a*. Printing is carried out by a discharged or sprayed out ink droplet 80*a*.

FIG. 54 is a sectional view schematically showing a structure of a second conventional ink jet head. Referring to FIG. 54, a second conventional ink jet head 330 includes a vessel 325 and a bimorph 324.

Vessel 325 includes cavity 325*a*, a nozzle orifice 325, and an ink feed inlet 325*c*. Cavity 325*a* can be filled with ink 80 via ink feed inlet 325*c*. Nozzle orifice 325*b* is provided at the sidewall of vessel 325. Cavity 325*a* communicates with the outside world of vessel 325 via nozzle orifice 325*b*. Bimorph 324 is arranged within cavity 325*a*.

Here a bimorph is referred to a structure where two electrodes are cemented to either side of a plate of a piezoelectric element. Therefore, bimorph 324 includes a piezoelectric element 321 and a pair of electrodes 323. Bimorph 324 has one end attached and fixed to the inner wall of vessel 325. Nozzle orifice 325*b* is located at a position facing the free end of bimorph 324. A power source 327 is connected to the pair of electrodes 323 to control the application of voltage by turning on/off a switch.

According to an operation of a second conventional ink jet head 330, cavity 325*a* is filled with ink 80. Voltage is applied to the pair of electrodes 323. More specifically, piezoelectric element 321 is displaced by application of voltage, whereby the free end of bimorph 324 is displaced in the direction of arrow $B_1$, i.e. is warped. Here, the switch is turned off to cease application of voltage to the pair of electrodes 323. This causes the free end of bimorph 324 to be displaced in the direction of arrow $B_2$ to result in the state shown in FIG. 55.

Referring to FIG. 55, pressure is applied to ink 80 in the direction of, for example, arrow $B_3$ as a result of displacement of bimorph 324. By this pressure in the direction of arrow $B_3$, ink 80 is discharged from nozzle orifice 325*b* to form an ink droplet 80*a*. Printing is carried out by ink droplets 80*a* discharged or sprayed out from nozzle orifice 325*b*.

A bubble type ink jet head will be described hereinafter as a third conventional ink jet head.

FIG. 56 is an exploded perspective view schematically showing a structure of a third conventional ink jet head. Referring to FIG. 56, a third conventional ink jet head 410 includes a heater unit 404 and a nozzle unit 405.

Heater unit 404 includes a heater 401, an electrode 403, and a substrate 411. Electrode 403 and heater 401 connected thereto are formed on the surface of substrate 411.

Nozzle unit 405 includes a nozzle 405*a*, a nozzle orifice 405*b*, and ink feed inlet 405*c*. A plurality of nozzles 405*a* are provided corresponding to heater 401. Nozzle orifice 405*b* is provided corresponding to each nozzle 405*a*. Ink feed inlet 405*c* is provided to supply ink to each nozzle 405*a*.

The operating mechanism of the bubble type ink jet head of the above-described structure will be described hereinafter.

FIGS. 57A–57E are sectional views of a nozzle showing the sequential steps of droplet formation of the bubble type ink jet head.

Referring to FIG. 57A, current flows to heater 401 by conduction of an electrode (not shown). As a result, heater 401 is heated rapidly, whereby core bubbles 81*a* are generated at the surface of heater 401.

Referring to FIG. 57B, ink 80 reaches the heating limit before the preexisting foam core is activated since heater 401 is rapidly heated. Therefore, core bubbles 81*a* on the surface of heater 401 are combined to form a film bubble 81*b*.

Referring to FIG. 57C, heater 401 is further heated, whereby film bubble 81*b* exhibits adiabatic expansion. Ink 80 receives pressure by the increase of volume of the growing film bubble 81*b*. This pressure causes ink 80 to be pressed outwards of orifice 405*b*. The heating of heater 401 is suppressed when film bubble 81*b* attains the maximum volume.

Referring to FIG. 57D, film bubble 81*b* is derived of heat by the ambient ink 80 since heating of heater 401 is suppressed. As a result, the volume of film bubble 81*b* is reduced, whereby ink 80 is sucked up within nozzle 405*a*. By this suction of ink 80, an ink droplet is formed from ink 80*a* discharged outside orifice 405*b*.

Referring to FIG. 57E, further reduction or elimination of the volume of film bubble 81*b* results in the formation of an ink droplet 80*a*.

According to an operation of a third conventional ink jet head 410, printing is carried out by discharging or spraying out ink droplet 80*a* formed by the above-described process.

The first, second and third conventional ink jet heads 310, 330, and 410, respectively, of the above-described structure include problems set forth in the following.

First and second conventional ink jet heads 310 and 330 using piezoelectric elements cannot obtain a great discharging force while maintaining the dimension of ink jet heads 310 and 330 at its small level. This will be described in detail hereinafter.

In the case where a piezoelectric element is used, an ink droplet is discharged by the deformation of the piezoelectric element caused by applying voltage. A greater level of voltage must be applied to the piezoelectric element in order to increase the amount of deformation of the piezoelectric element. However, there is a limit in the increase of the voltage applied to the piezoelectric element in view of the breakdown voltage of the ink jet head. Under such a condition where the applied voltage value is restricted, a great amount of deformation of the piezoelectric element cannot be ensured.

In the first conventional ink jet head 310 shown in FIGS. 52 and 53, piezoelectric elements 301 are layered in the longitudinal direction to obtain a greater amount of displacement. More specifically, in ink jet head 310, voltage is applied in the unit of each of the layered piezoelectric elements 301 to obtain an amount of displacement from each piezoelectric element 301 effectively, resulting in a relatively great amount of displacement in the longitudinal direction. However, this amount of displacement is not sufficient by the layered piezoelectric elements 301 due to the limited applied voltage.

When a PZT that can convert voltage into an amount of displacement most efficiently at the current available standard is layered as the piezoelectric element in the first conventional ink jet head 301 with a cross sectional configuration of 2 mm×3 mm and a length of 9 mm, the layered piezoelectric elements can be displaced only 6.7 μm in the direction of arrow $A_1$ at an applied voltage of 100 V.

An approach structure can be considered of increasing the number of layers of piezoelectric elements 301 in order to obtain a greater amount of displacement in ink jet head 310. However, increase in the number of layers of piezoelectric elements 301 will result in a greater dimension in the longitudinal direction of the entire layered piezoelectric element 304. This entire increase in the size of the layered piezoelectric element will lead to increase in the size of pressure chamber 305*a* in which the piezoelectric elements are arranged. Therefore, increase in the size of ink jet head 301 cannot be avoided.

Similar to the second conventional ink jet head 330 shown in FIGS. 54 and 55, displacement in the direction of thickness of bimorph 324 (the direction of arrow $B_1$) cannot be increased since a great amount of displacement of the piezoelectric element per se cannot be ensured.

When a PZT is used as the piezoelectric element and the bimorph has a dimension of 6 mm in length, 0.15 mm in thickness, and 3 mm in width in the second conventional ink jet head 330, bimorph 324 is displaced only 12 μm in the direction of arrow $B_1$ with an applied voltage of 50 V.

An approach can be considered of increasing the entire length of bimorph 324 to increase the amount of displacement in the thickness direction. Although the amount of displacement ($C_1$) in the thickness direction is relatively low in bimorph 324 having a short length as shown in FIG. 58, the amount of displacement ($C_2$) can be increased if the entire length is lengthened. It is to be noted that FIG. 58 is a side view of the bimorph for describing the amount of displacement in the thickness direction of the bimorph.

However, increase in the entire length of bimorph 324 in order to obtain a greater amount of displacement leads to cavity 325*a* of a greater volume in vessel 325. Therefore, increase in the size of ink jet head 330 cannot be avoided.

Thus, there was a problem that formation of a multinozzle head in which nozzles are integrated becomes difficult if the dimension of first and second conventional ink jet heads 310 and 330, respectively, is increased.

First conventional ink jet head 310 and second conventional ink jet head 330 use a PZT as the piezoelectric element. This PZT can be formed by a thin film formation method (for example, sputtering). However, a PZT used in first and second ink jet heads 310 and 330 is increased in the film thickness of the piezoelectric element per se. It is difficult to form such film thickness at one time by a general thin film formation method. In order to form a thick piezoelectric element by a thin film formation method, the piezoelectric elements must be layered according to a plurality of steps. Such a manufacturing method is complicated and will increase the cost.

There is also a problem that the lifetime of a bubble type ink jet head is reduced in the third conventional ink jet head 410. This will be described in detail hereinafter.

According to the bubble type ink jet head 410 shown in FIG. 56, a film boiling phenomenon must be established to obtain a thorough bubble 81*b* on the basis of the process shown in FIGS. 57A–57C. It is therefore necessary to rapidly heat heater 401. More specifically, heater 401 is heated to approximately 1000° C. in order to heat ink 80 to a temperature of approximately 300° C. High speed printing is realized by repeating heating and cooling in a short time by heater 401. This repeated procedure of heating to a high temperature and then cooling will result in thermal fatigue of heater 401 even if a material such as $H_4B_4$ superior in heat resistance is used for heater 401. Thus, bubble type ink jet head 410 has the problem of deterioration of heater 401 to result in reduction in the lifetime of the ink jet head.

SUMMARY OF THE INVENTION

An object of the present invention is to provide an ink jet head of a long lifetime that can obtain a great discharge force while maintaining a small dimension.

Another object of the present invention is to provide an ink jet head in which both ends of a buckling structure body does not easily come off, that is superior in endurance, and that has a strong force generated by deformation of the buckling structure body.

A further object of the present invention is to control the actuating direction of a buckling structure body with a simple structure.

Still another object of the present invention is to provide an ink jet head that has high speed response and that can be adapted for high speed printing.

According to an aspect of the present invention, an ink jet head having pressure applied to ink filled in the interior to discharge ink outwards includes a nozzle plate, a vessel, a buckling structure body, and compression means. The nozzle plate includes a nozzle orifice. The vessel has an ink flow path communicating with the nozzle orifice. The buckling structure body has the center portion located between the nozzle orifice and the ink flow path, and both ends supported by being sandwiched between the nozzle plate and the vessel. The compression means serves to apply compressive stress inwards of the buckling structure body. The buckling structure body is buckled by a compressive stress applied by the compression means, whereby the middle portion of the buckling structure body is deformed towards the nozzle orifice.

According to the ink jet head of the above-described structure, both ends of the buckling structure body is sandwiched between the nozzle plate and the vessel to be supported firmly. Therefore, even if the buckling structure body is repeatedly deformed at high speed by buckling, both ends of the buckling structure body will not easily come off the vessel, resulting in superior endurance.

Both ends of the buckling structure body sandwiched between the nozzle plate and the vessel provides the advantage of suppressing deformation of the vessel caused by actuation of the buckling structure body even when the vessel is formed of a thin structure. This prevents the force generated by deformation of the buckling structure body from being diminished by deformation of the vessel.

According to another aspect of the present invention, an ink jet head applying pressure to ink filled in the interior to discharge ink outwards includes a nozzle plate, a vessel, a buckling structure body, and compression means. The nozzle plate includes a nozzle orifice. The vessel has an ink flow path communicating with the nozzle orifice. The buckling structure body has the center portion located between the nozzle orifice and the ink flow path, and a surface facing the nozzle orifice and a back face located at the rear of the surface. The buckling structure body has both ends supported by the vessel at the back face. The compression means serves to apply a compressive stress inwards of the buckling structure body. The buckling structure body is buckled by the compressive stress applied by the compression means, whereby the center portion of the buckling structure body is deformed towards the nozzle orifice.

The ink jet head of the above-described structure has both ends of the buckling structure body supported by the vessel at the back that faces the nozzle orifice. By action of a moment, the buckling structure body is deformed also towards the nozzle plate. Therefore, the actuation direction of the buckling structure body can be controlled with a simple structure.

According to a further aspect of the present invention, an ink jet head applying pressure to ink filled in the interior for discharging ink outwards includes a nozzle plate, a substrate, a buckling structure body, and compression means. The nozzle plate has a nozzle orifice. The substrate has an ink flow path communicating with the nozzle orifice. The buckling structure body has the center portion located between the nozzle orifice and the ink flow path, and both ends supported at least by the substrate. The compression means serves to apply a compressive stress inwards of the buckling structure body. The buckling structure body is buckled according to the compressive stress applied by the compression means, whereby the center portion of the buckling structure body is deformed towards the nozzle orifice. The distance between the buckling structure body and the substrate is not more than 10 μm. The width of the ink flow path in the substrate at the closest position to the buckling structure body is not more than ⅓ the length of the buckling portion of the buckling structure body. The material of the substrate has a thermal conductivity of at least $70W \cdot m^{1-1} \cdot K^{-1}$.

Because the ink jet head of the above-described structure has the dimension of each unit and the material of the substrate limited, the heat radiation of the heated buckling structure body is superior. The buckling structure body heated to a high temperature can be cooled rapidly, resulting in a superior response of heating and cooling. Thus, the ink jet head of the above-described structure is applicable to high speed printing due to its high speed response.

The ink jet head according to the above three aspects of the present invention has the buckling structure body deformed by buckling. This buckling allows the amount of displacement of the buckling structure body in the longitudinal direction to be converted into the amount of displacement in the thickness direction. In deformation based on buckling, even a small amount of displacement in the longitudinal direction can be converted into a great amount of displacement in the thickness direction. Thus, a great amount of displacement can be obtained without increasing the dimension of the buckling structure body. Thus, a greater discharge force can be obtained. The buckling structure body can be buckled by fixing both ends of the buckling structure body in the longitudinal direction, which is extremely simple in structure. Thus, the dimension can be reduced easily. Thus, an ink jet head is obtained that can provide a greater discharge force while maintaining the small size.

The buckling structure body must be heated to induce buckling by heating. However, it is not necessary to heat the buckling structure body to a temperature at which ink itself is vaporized. In other words, it is only necessary to heat the buckling structure body up to a temperature according to the coefficient of thermal expansion of the material. The buckling structure body does not have to be heated to a high temperature as in the case of a conventional bubble type ink jet head. Therefore, thermal fatigue caused by the repeated operation of heating to a high temperature and cooling is reduced. Accordingly, deterioration of the plate member is reduced to increase the lifetime thereof. Furthermore, power consumption is reduced since there need for only a lower calorie.

A method of manufacturing an ink jet head for applying pressure to ink filled in the interior for discharging ink outwards according to an aspect of the present invention includes the following steps.

On a main surface of a vessel, a buckling structure body is formed having both ends supported on the main surface of the vessel. An ink flow path having an opening is formed piercing the vessel and facing the center portion of the buckling structure body. A nozzle plate having a nozzle orifice is formed. The nozzle plate is coupled to the vessel and the buckling structure body so that both ends of the buckling structure body is sandwiched and supported between the vessel and the nozzle plate, and so that the center portion of the buckling structure body is located between the nozzle orifice and the ink flow path.

According to the method of manufacturing an ink jet head of the above aspect, an ink jet head can be provided in which both ends of the buckling structure body does not easily come off the vessel, that is, superior in endurance, and that generates a great force by the deformation of the buckling structure body.

A method of manufacturing an ink jet head applying pressure to ink filled in the interior for discharging the ink outwards includes the following steps.

A substrate is prepared of a material having a thermal conductivity of at least $70W \cdot m^{-1} \cdot K^{-1}$. A buckling structure body is formed having both ends supported on the main surface of the substrate so that the distance between the buckling structure body and the substrate is not more than 10 μm. An ink flow path having an opening is formed piercing the vessel and facing the center portion of the buckling structure body. The opening diameter of the ink flow path is not more than ⅓ the length of the buckling portion of the buckling structure body at the ink flow path located closest to the buckling structure body. A nozzle plate is connected to the substrate so that the center portion of the buckling structure body is located between the nozzle orifice and the ink flow path.

According to an ink jet head manufacturing method of the above aspect, an ink jet head can be manufactured superior in heat radiation of the buckling structure body, applicable to high speed response for high speed printing.

The foregoing and other objects, features, aspects and advantages of the present invention will become more apparent from the following detailed description of the present invention when taken in conjunction with the accompanying drawings.

Pig. 42A is a graph showing the temperature profile of the buckling structure body.

Figure 42A:
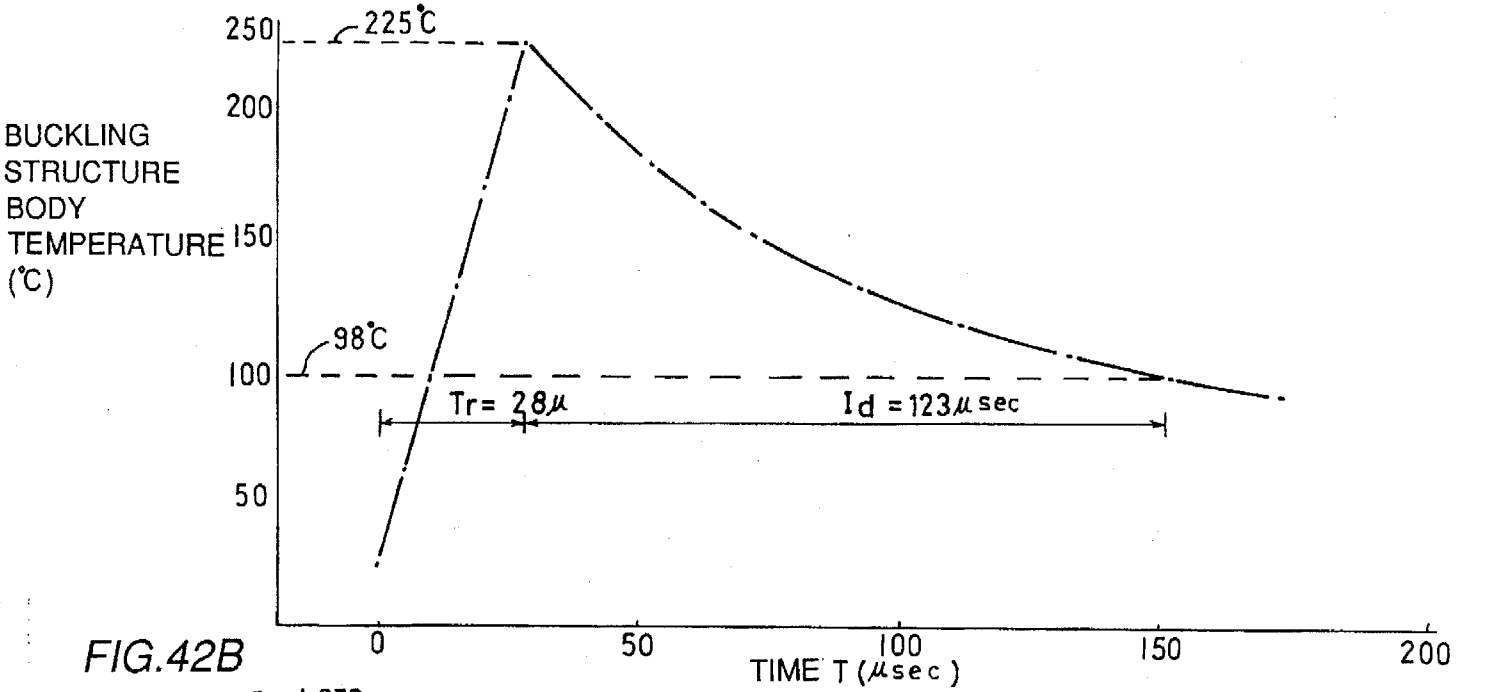
Figure 42B:
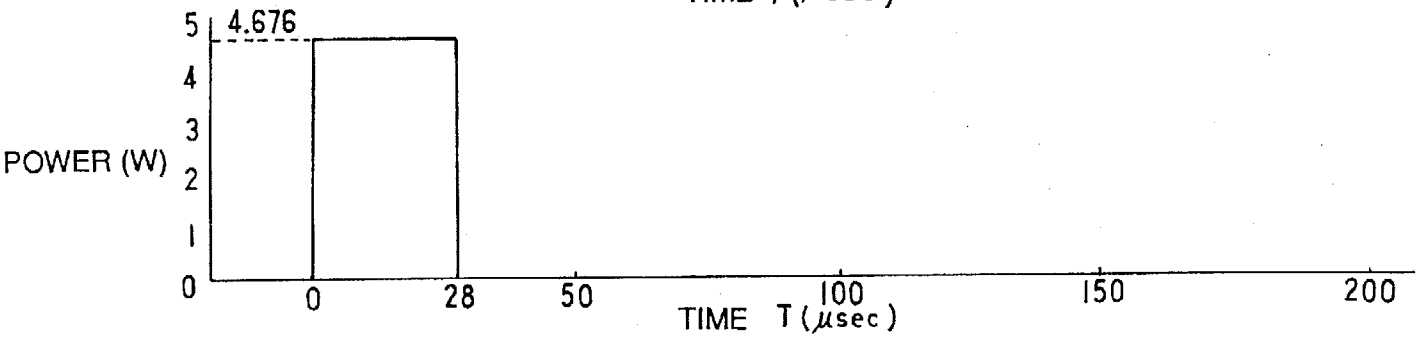

FIG. 42B is a graph of the drive waveform.

FIGS. 43A–43H are sectional views of the ink jet head according to the fifth embodiment of the present invention showing sequential steps of manufacturing a casing thereof.

Figure 44:
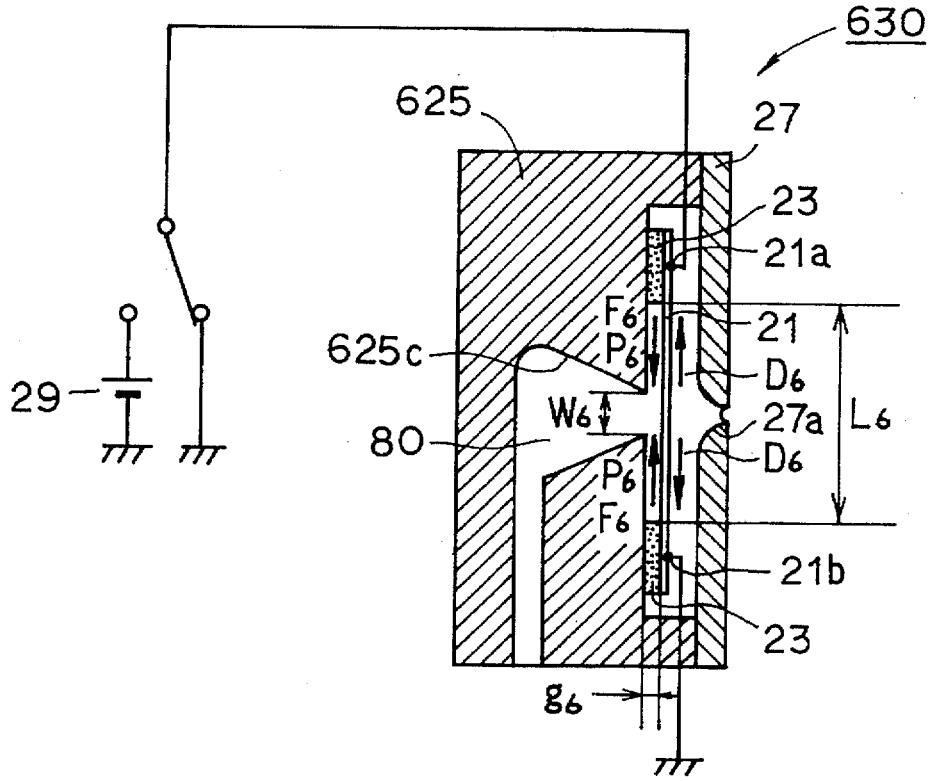
Figure 45:
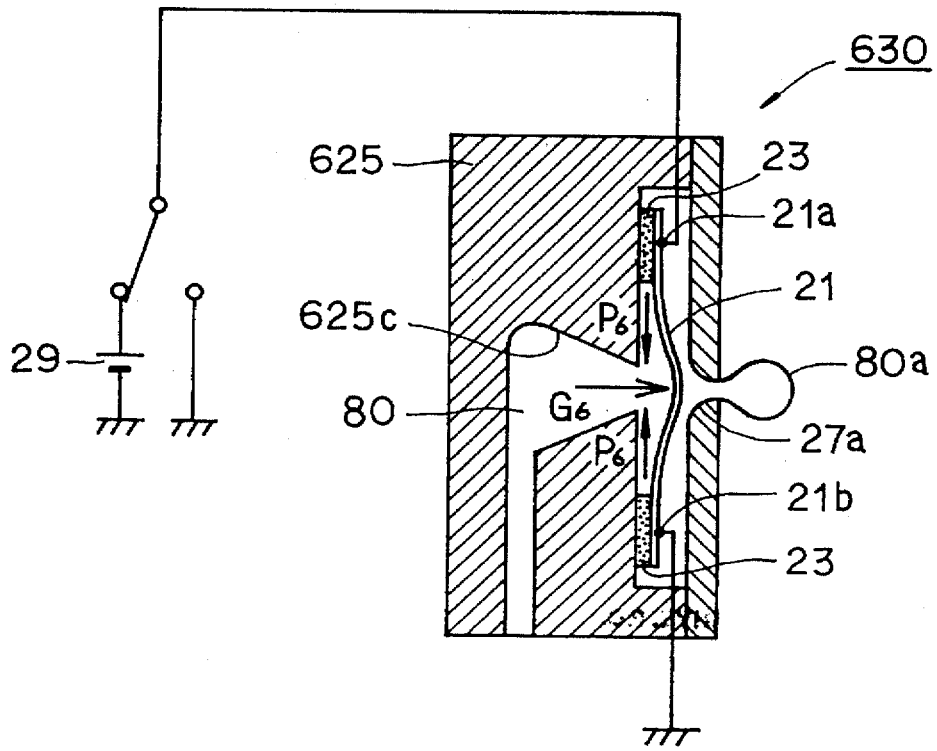

FIGS. 44 and 45 are sectional views of an ink jet head according to a sixth embodiment of the present invention showing a standby state and an operating state, respectively.

Figure 46:
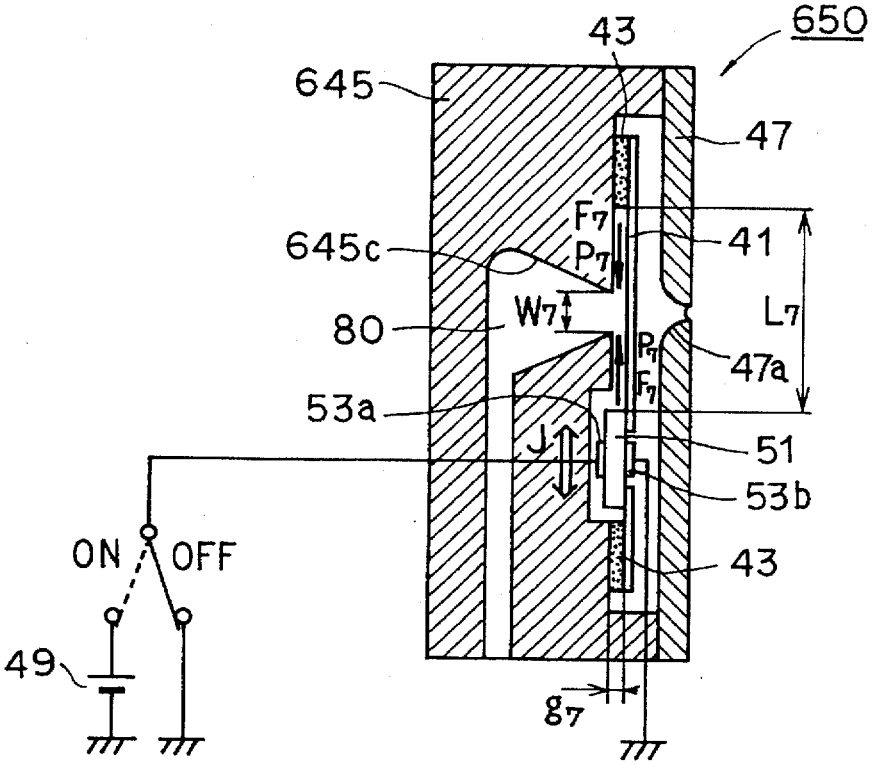
Figure 47:
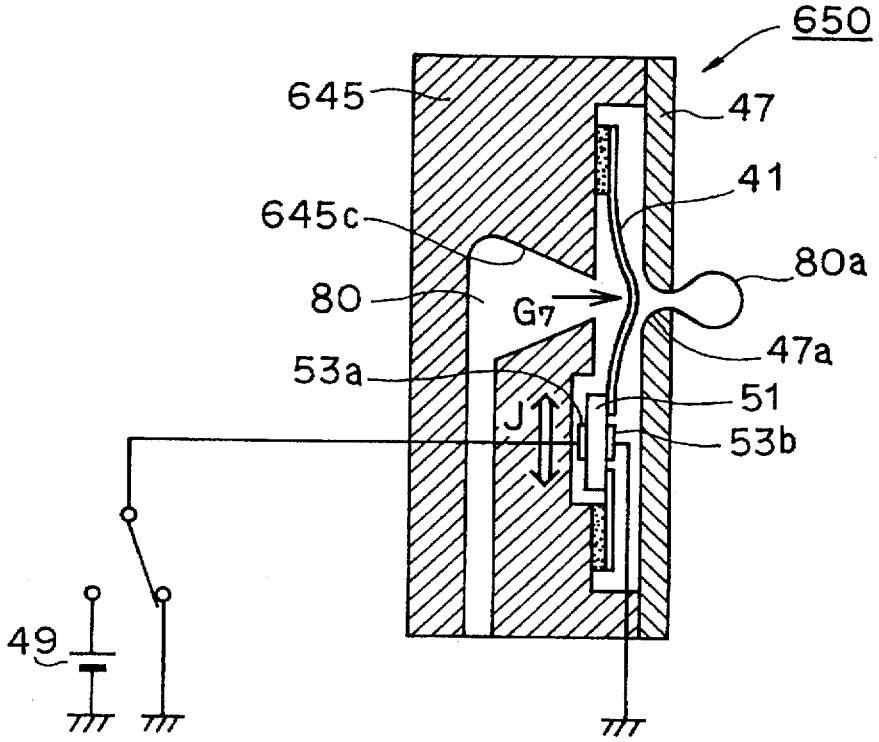

FIGS. 46 and 47 are sectional views of an ink jet head according to a seventh embodiment of the present invention showing a standby state and an operating state, respectively.

Figure 48:
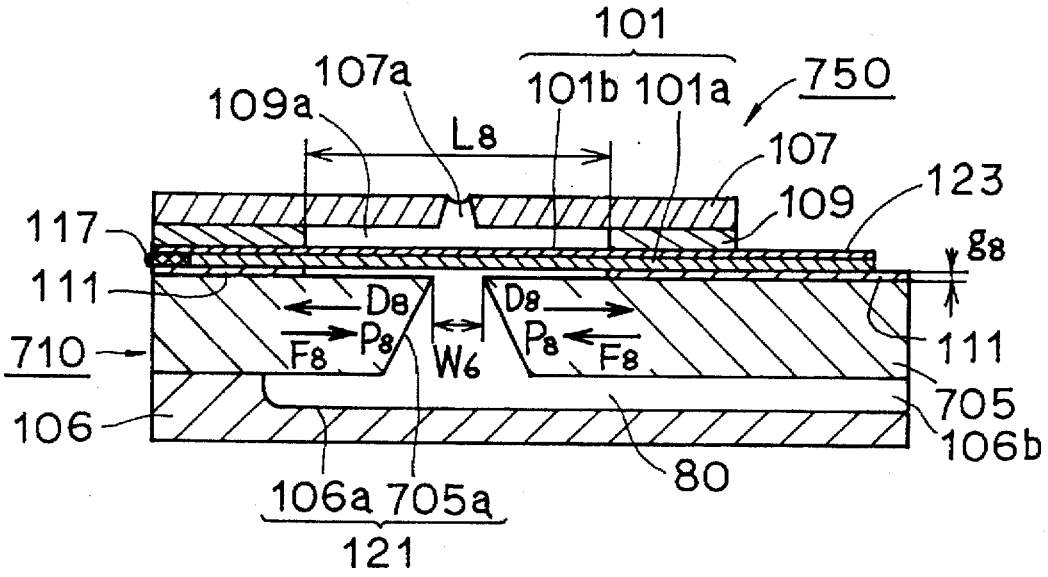
Figure 49:
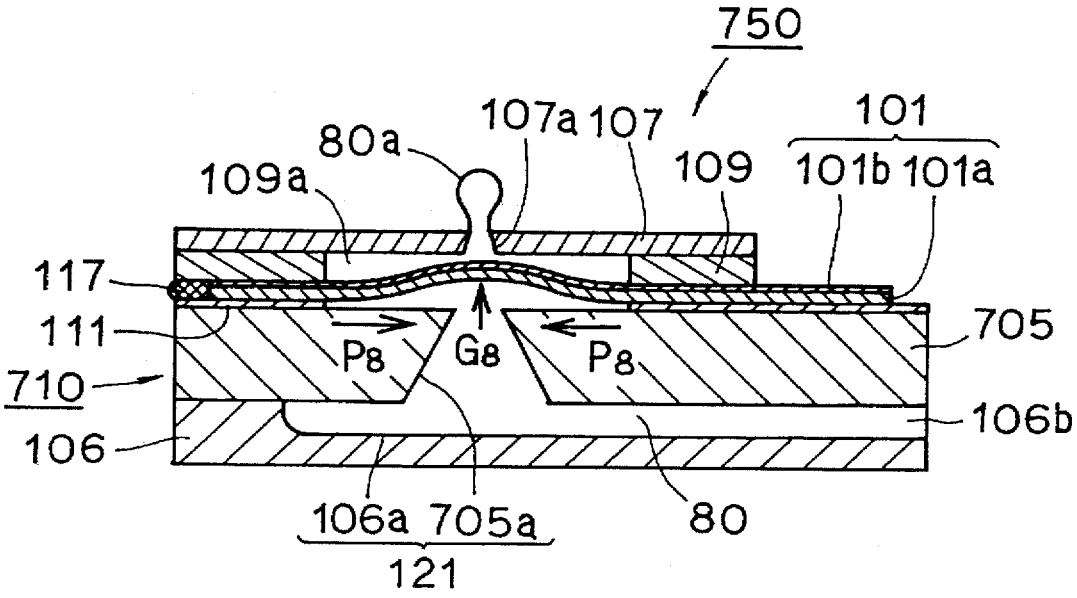

FIGS. 48 and 49 are sectional views of an ink jet head according to an eighth embodiment of the present invention showing a standby state and an operating state, respectively.

Figure 50:
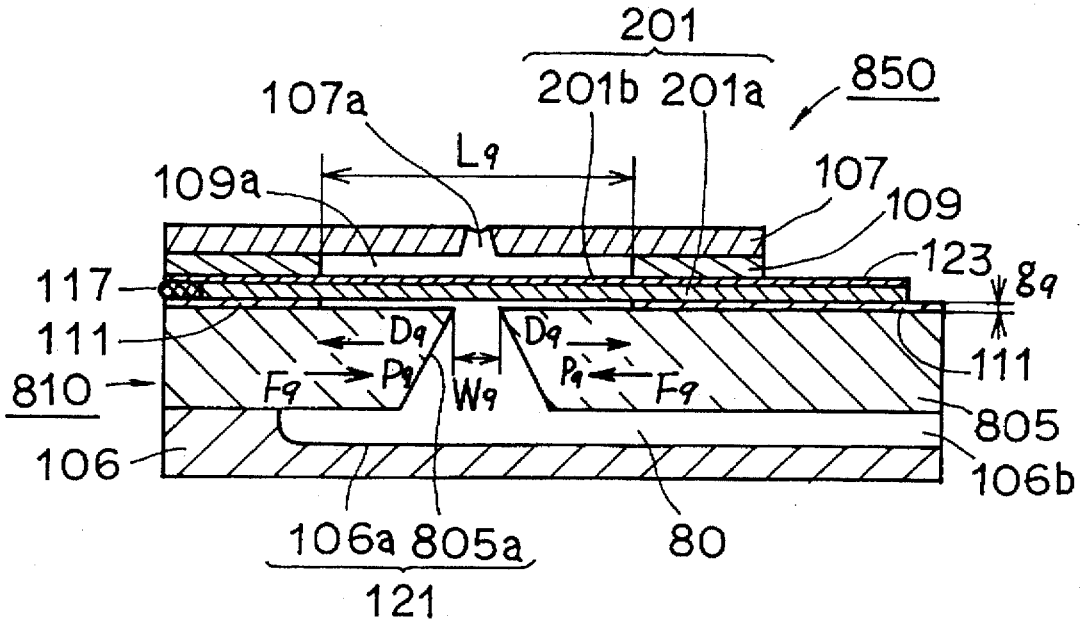
Figure 51:
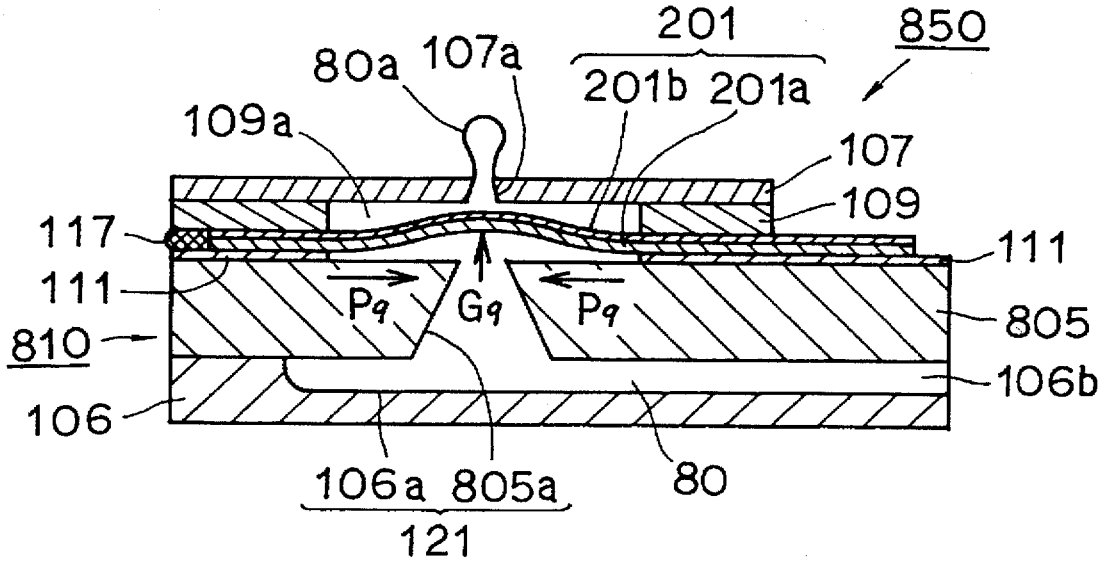

FIGS. 50 and 51 are sectional views of an ink jet head according to a ninth embodiment of the present invention showing a standby state and an operating state, respectively.

Figure 52:
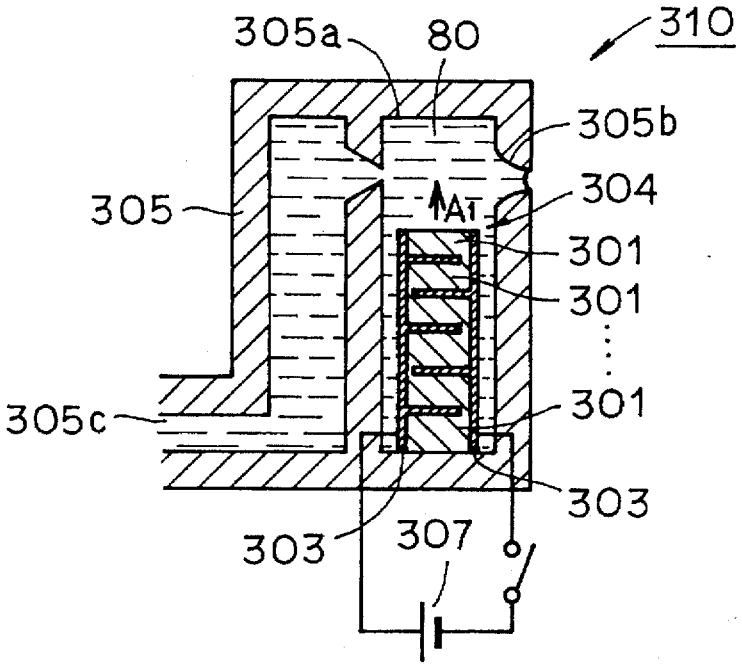
FIG.52 PRIOR ART
Figure 53:
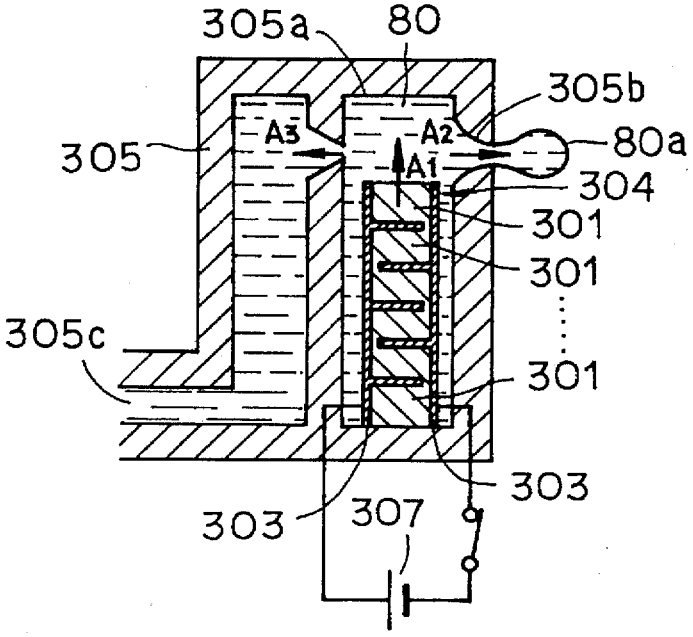
FIG.53 PRIOR ART

FIGS. 52 and 53 are sectional views of a first conventional ink jet head showing a standby state and an operating state, respectively.

Figure 54:
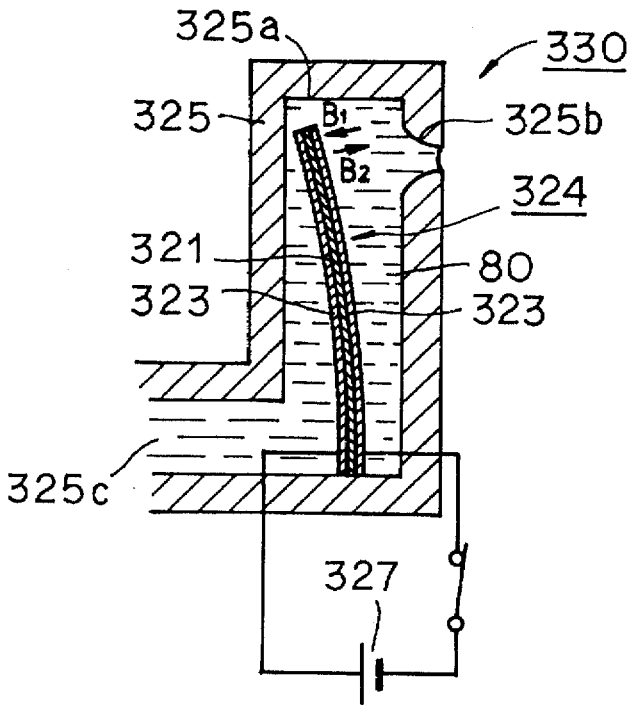
FIG.54 PRIOR ART
Figure 55:
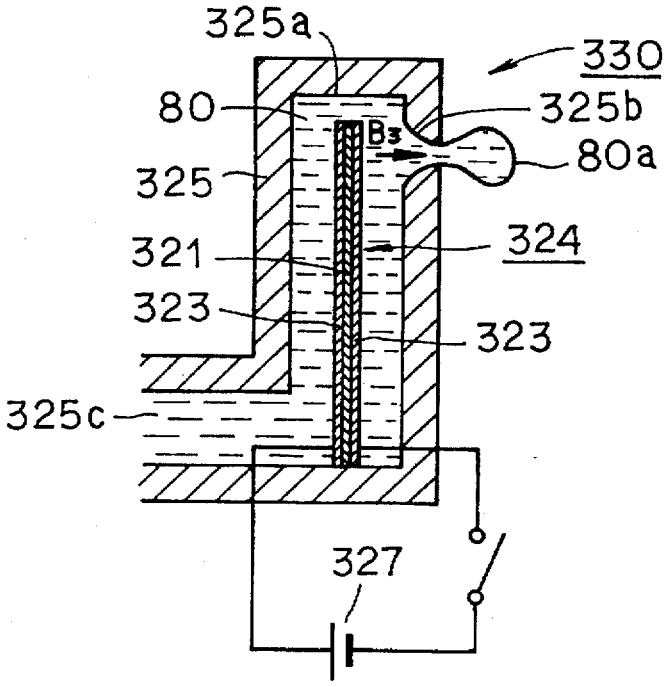
FIG.55 PRIOR ART

FIGS. 54 and 55 are sectional views of a second conventional ink jet head showing a standby state and an operating state, respectively.

Figure 56:
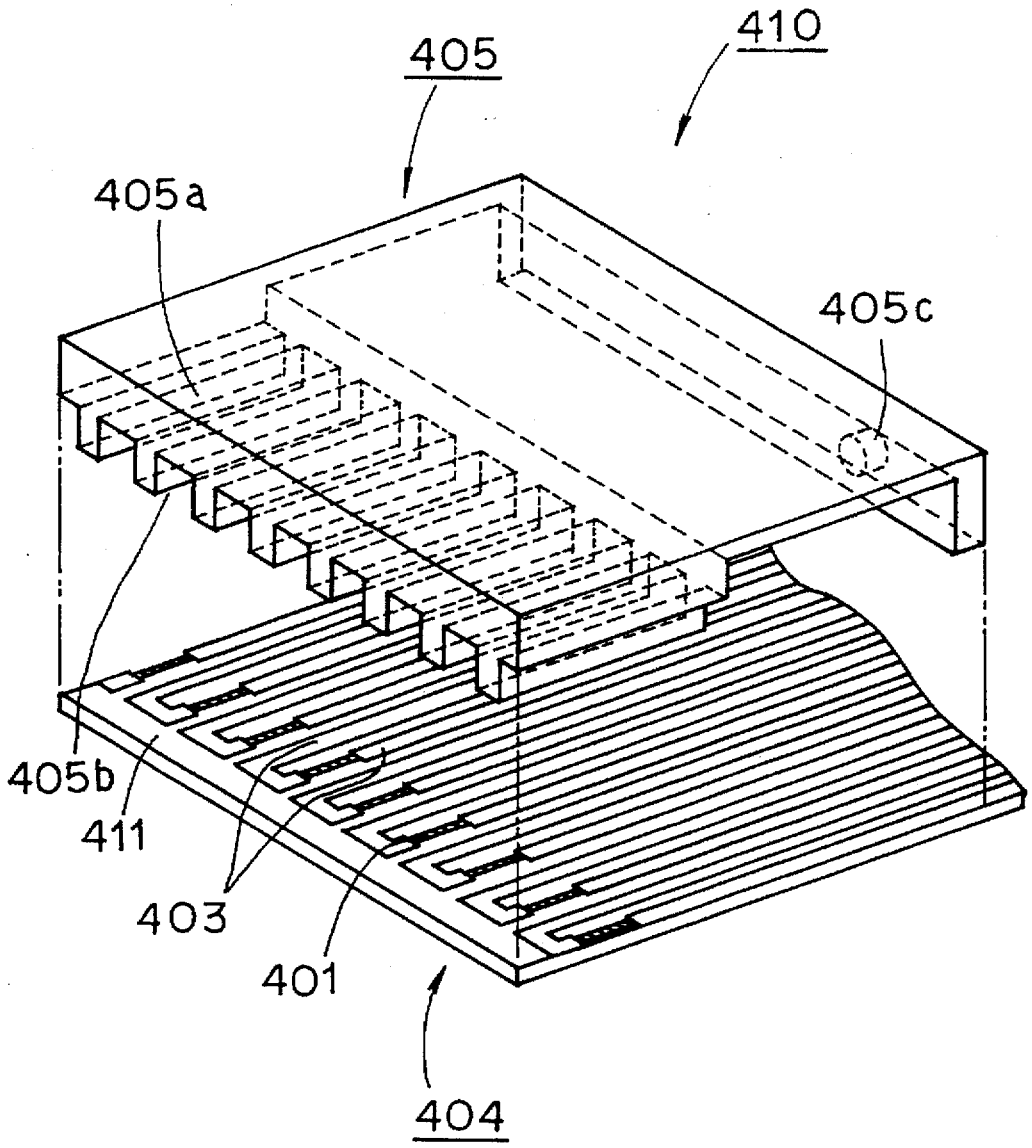
FIG.56 PRIOR ART
Figure 57A:
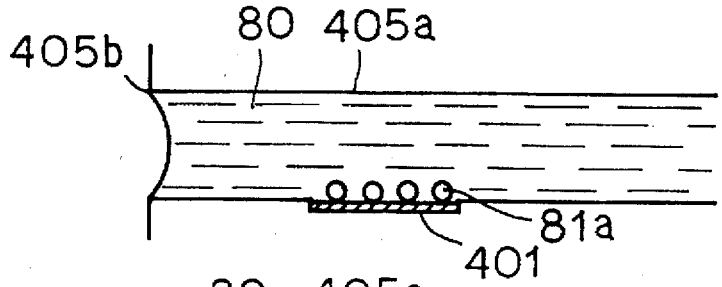
FIG.57A PRIOR ART
Figure 57B:
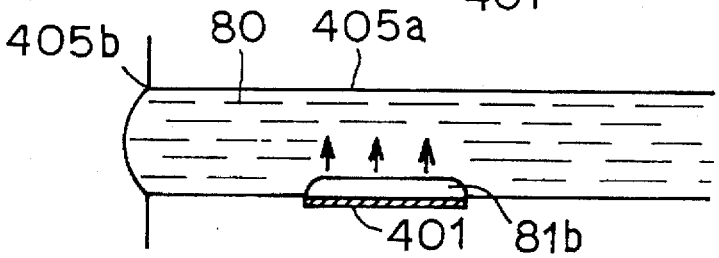
FIG.57B PRIOR ART
Figure 57C:
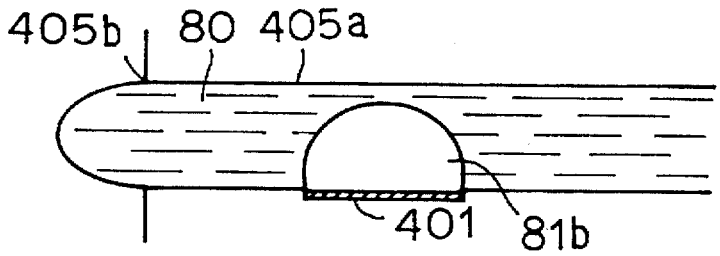
FIG.57C PRIOR ART
Figure 57D:
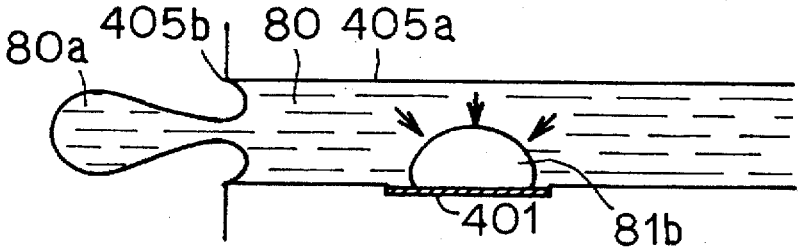
FIG.57D PRIOR ART
Figure 57E:
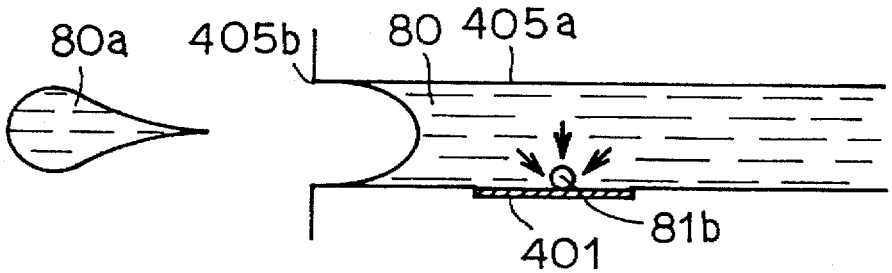
FIG.57E PRIOR ART

FIG. 56 is an exploded perspective view of a third conventional ink jet head.

FIGS. 57A–57F are operation step views for describing the recording mechanism of a bubble jet type ink jet head.

Figure 58:
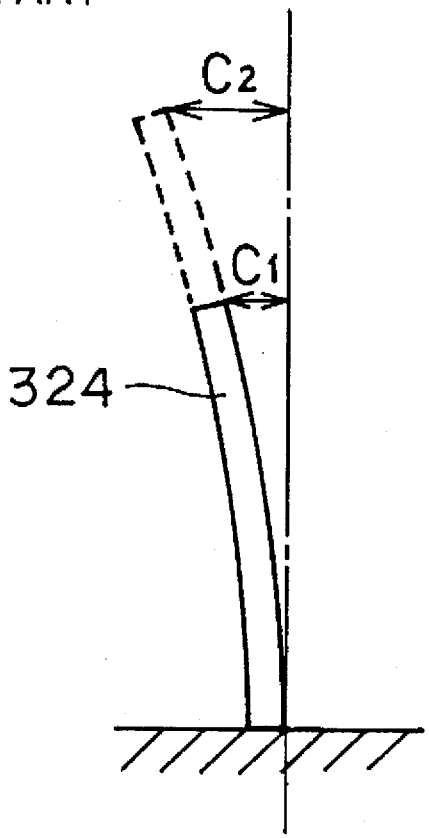
FIG.58 PRIOR ART

FIG. 58 is a diagram for describing problems encountered in the second conventional ink jet head.

DESCRIPTION OF THE PREFERRED EMBODIMENTS

Embodiments of the present invention will be described hereinafter with reference to the drawings.

Figure 1:
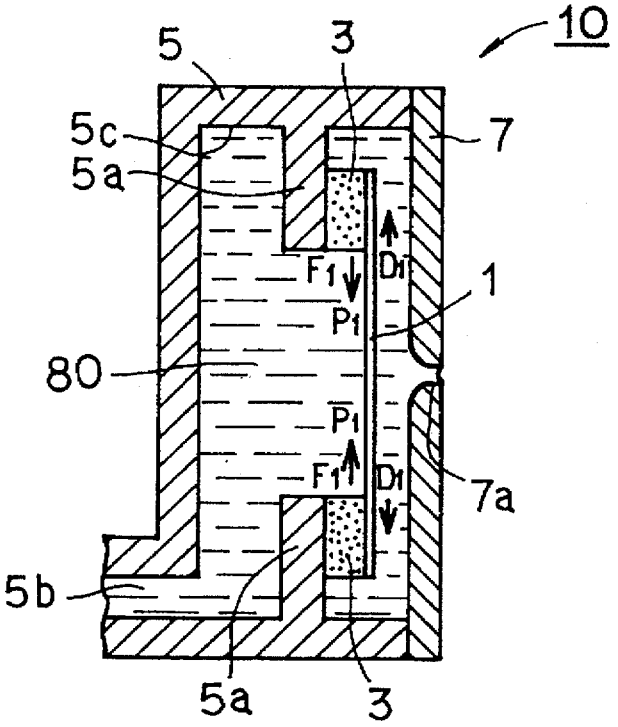
FIGS. 1 and 2 are sectional views of an ink jet head for describing the recording mechanism of the ink jet head of the present invention.

Referring to FIG. 1, an ink jet head according to the present invention includes a buckling structure body 1, a compressive force generation means 3, a casing 5, and a nozzle plate 7.

A vessel with a hollow cavity is formed by casing 5 and nozzle plate 7. A plurality of nozzle orifices 7*a* are provided in nozzle plate 7. Each nozzle orifice 7*a* is formed in a conical or funnel configuration. An ink feed inlet 5*b* is provided at the inner wall of casing 5 for supplying ink 80 inside the hollow cavity. The inner wall of ink supply inlet 5*b* forms an ink flow path 5*c*. A pair of attach frames 5*a* extending inwards is provided at the inner wall of casing 5. A buckling structure body 1 is fixedly attached to the surface of the pair of attach frames 5*a* facing nozzle orifice 7*a* via compressive force generation means 3.

Buckling structure body 1 is a plate-like member extending in the planar direction (longitudinal direction). Both ends in the longitudinal direction of buckling structure body 1 is fixedly attached to compressive force generation means 3.

Buckling structure body 1 is formed of a material that contracts and expands at least in the longitudinal direction (in the direction of arrow D) by an external factor such as heating. Nozzle orifice 7*a* is located in nozzle plate 7 facing buckling structure body 1.

Figure 2:
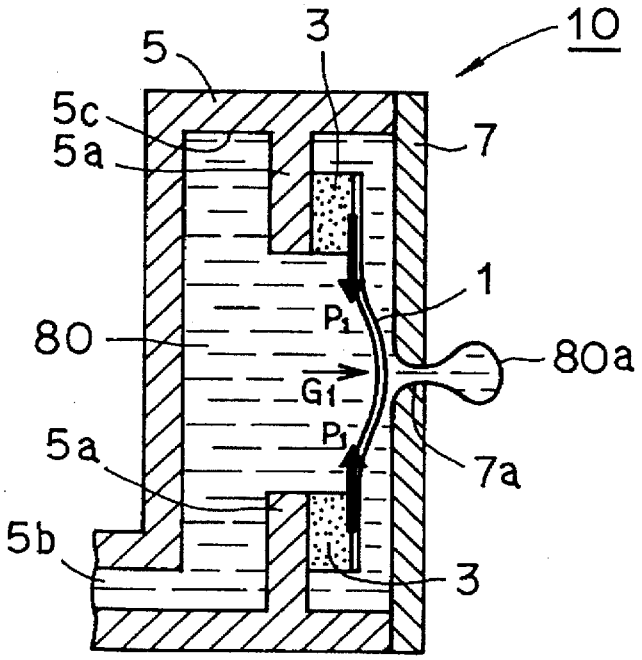

According to an operation of ink jet head 10, ink 80 is supplied from ink feed inlet 5*b*, so that the hollow cavity interior of the vessel is filled with ink 80. Buckling structure body 1 is therefore immersed in ink 80. Then, buckling structure body 1 is, for example, heated. This causes buckling structure body 1 to expand in the longitudinal direction (the direction of arrow $D_1$). However, both ends in the longitudinal direction of buckling structure body 1 are fixed to attach frames 5*a* by compressive force generation means 3. Therefore, buckling structure body 1 cannot expand in the longitudinal direction. Instead, a compressive force $P_1$ is applied in the direction of arrow $F_1$ as a reactive force thereof, which is accumulated in buckling structure body 1. Buckling structure body 1 establishes a buckling deformation as shown in FIG. 2 when compressive force $P_1$ exceeds the buckle load $P_c$ of buckling structure body 1.

By virtue of the buckle deformation of buckling structure body 1, pressure is exerted to ink 80 between buckling structure body 1 and nozzle plate 7. This applied pressure is propagated through ink 80, whereby ink 80 is urged outwards via nozzle orifice 7*a*. As a result, an ink droplet 80*a* is formed outside ink jet head 10 to be sprayed outwards. Thus, printing (recording) onto a printing face is carried out by spraying out ink droplet 80*a*.

A specific structure of the present invention employing the above-described recording mechanism will be described hereinafter.

Embodiment 1

Figure 3:
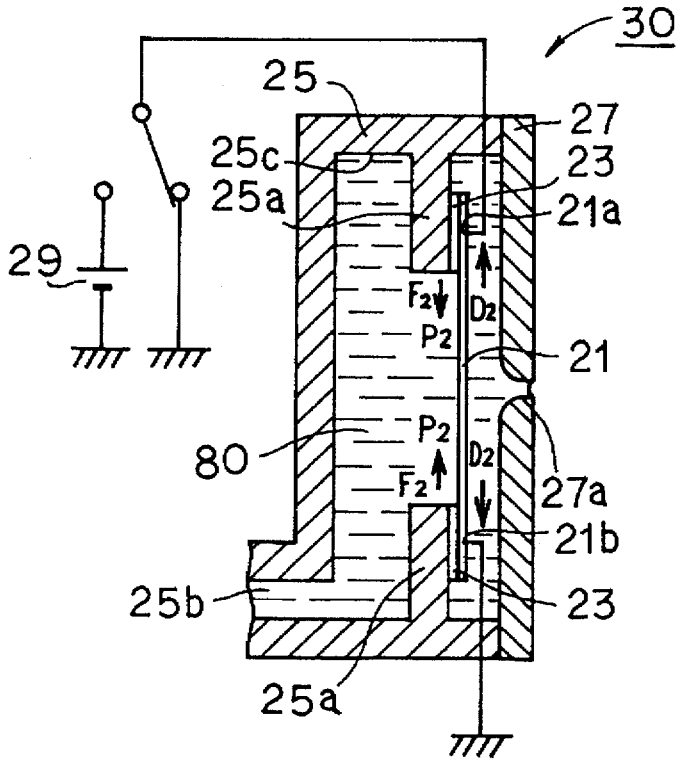
FIGS. 3 and 4 are sectional views schematically showing an ink jet head according to a first embodiment of the present invention in a standby state, and an operating state, respectively.

Referring to FIG. 3, an ink jet head 30 according to a first embodiment of the present invention includes a buckling structure body 21, an insulative member 23, a casing 25, a nozzle plate 27, and a power source 29.

Similar to the description of FIG. 1, a hollow cavity is provided by casing 25 and nozzle plate 27. An ink feed inlet 25*b* is provided in casing 25 to supply ink into the hollow cavity. At the inner wall of casing 25 which forms an ink flow path 25*c*, attach frames 25*a* are provided extending inwards. Buckling structure body 21 is fixedly attached via insulative member 23 to the surface of attach frame 25*a* facing nozzle plate 27. A plurality of nozzle orifices 27*a* are formed in nozzle plate 27 facing buckling structure body 21. Each nozzle orifice 27*a* has a conical or funnel-like configuration, communicating with the outside world.

Buckling structure body 21 is formed of a material such as metal that has conductivity and that can generate elastic deformation. Buckling structure body 21 is rectangular. A pair of electrodes 21*a* and 21*b* for energizing current are provided at both ends of buckling structure body 21. One of electrodes 21*a* can be connected to power source 29 by a switch. The connection and disconnection between one electrode 21*a* and power source 29 can be selected by turning on/off the switch. The other electrode 21*b* is grounded.

According to an operation of ink jet head 30 of the present embodiment, ink 80 is supplied through ink feed inlet 25*b* to fill the hollow cavity interior with ink 80. As a result, buckling structure body 21 is immersed in ink 80.

Here, the switch is turned on to apply voltage to one electrode 21*a*, whereby current flows to buckling structure body 21. Buckling structure body 21 is heated by resistance heating to yield thermal expansion. More specifically, buckling structure body 21 tries to expand at least in the longitudinal direction (arrow $D_2$) by thermal expansion.

Figure 4:
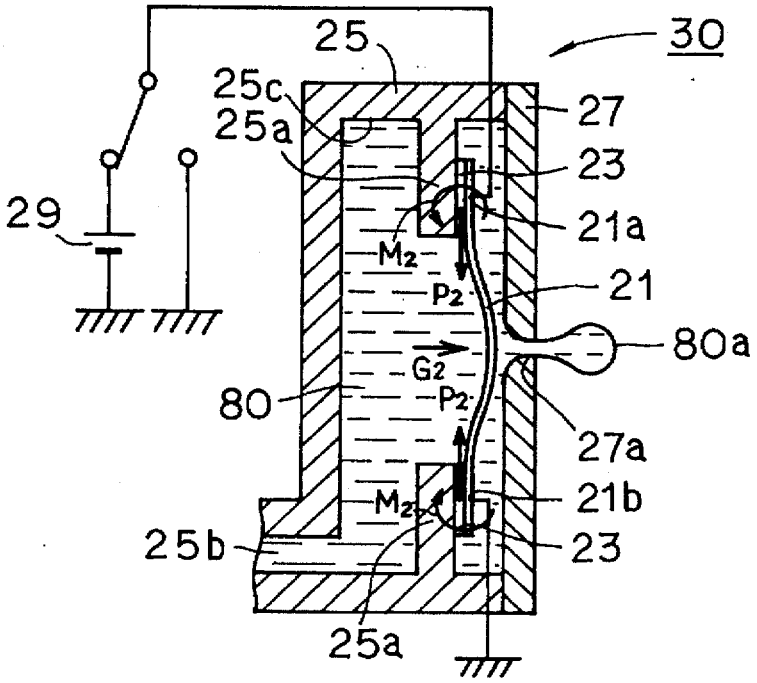

However, expansion deformation cannot be established since both ends in the longitudinal direction of buckling structure body 21 are fixed to attach frame 5*a* via insulative member 23. Therefore, compressive force $P_2$ is exerted from both ends of buckling structure body 21 in arrow $F_2$ to be accumulated. When compressive force $P_2$ exceeds the buckle load $P_c$ of buckling structure body 21, buckling deformation as shown in FIG. 4 occurs in buckling structure body 21.

According to this buckle deformation, buckling structure body 21 buckles so that the center portion in the longitudinal direction of buckling structure body 21 is displaced towards nozzle plate 27. This buckling of buckling structure body 21 causes pressure to be exerted to ink 80 between buckling structure body 21 and nozzle plate 27. The applied pressure is propagated through ink 80, whereby ink 80 is urged outwards of ink jet head 30 via nozzle orifice 27*a*. As a result, an ink droplet 80*a* is formed outside ink jet head 30 to be sprayed out. Thus, printing is carried out with the sprayed ink droplet 80*a*.

The buckling deformation will be described in detail hereinafter with reference to FIGS. 5A and 5B.

Figure 5A:
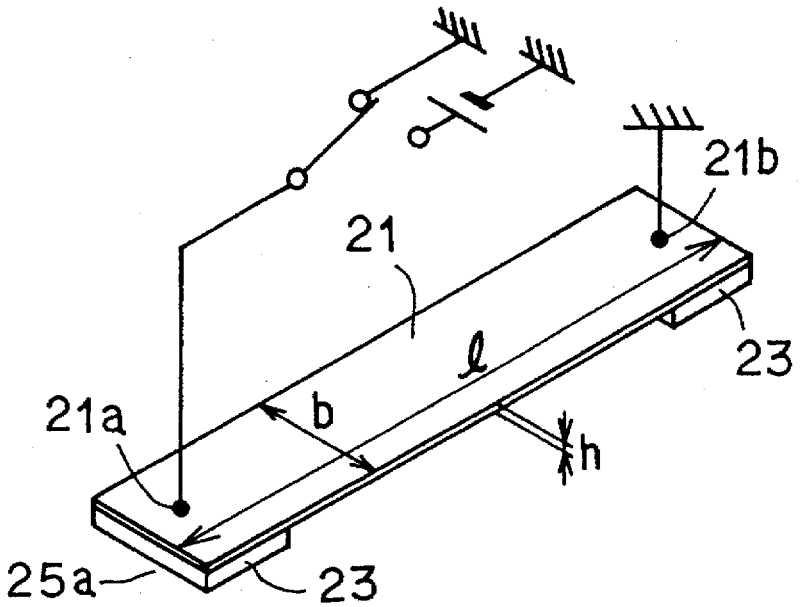
FIGS. 5A and 5B are perspective views of the ink jet head according to the first embodiment of the present invention showing the manner of displacement of a buckling structure body.
Figure 5B:
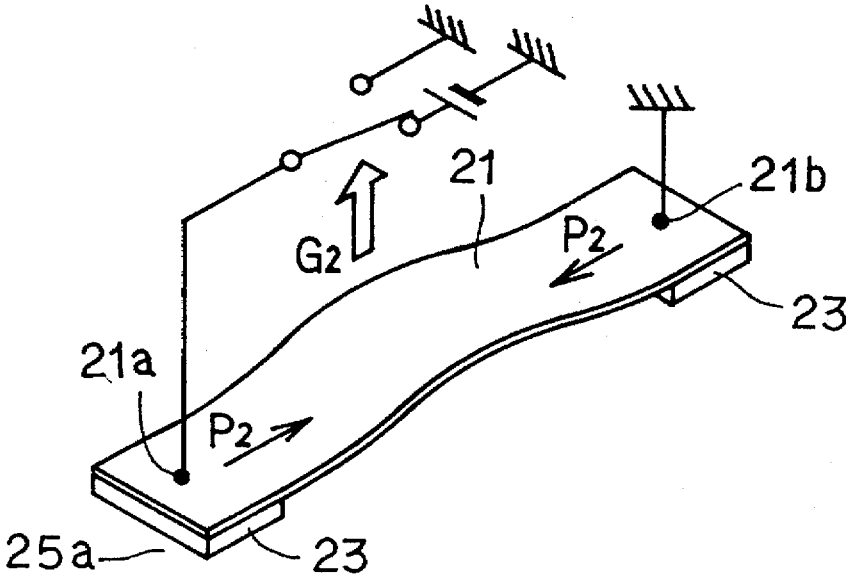

Referring to FIG. 5A, buckling structure body 21 has a modulus of direct elasticity of E ($N/m^2$), a coefficient of linear expansion of $\alpha$, a length of l(m), a width of b(m), and a thickness of h(m). When the rise in temperature of buckling structure body 21 is T (° C.), the compressive force $P_2$ is expressed as $E\alpha Tbh$(N). When compressive force $P_2$ is below the buckle load $P_c$ of buckling structure body 21, displacement is not seen in buckling structure body 21, and compressive force $P_2$ is accumulated in buckling structure body 21 as internal stress. Buckling structure body 21 is buckled to exhibit buckling deformation when compressive force $P_2$ exceeds buckle load $P_c$. This deformation causes the center portion in the longitudinal direction of buckling structure body 21 to be displaced in the direction of arrow $G_2$ as shown in FIG. 5B.

Buckling structure body 21 is displaced in the direction of arrow $G_2$ due to a compressive force $P_2$ being generated at the interface with insulative member 23 that fixes buckling structure body 21. This compressive force is generated at a region side of buckling structure body 21 opposite to the nozzle plate side as shown in FIG. 4.

More specifically, both ends of buckling structure body 21 are fixed to casing 25 via insulative member 23 at the back cavity side of the surface of buckling structure body 21 facing nozzle orifice $27_a$. During operation of ink jet head 30, compressive force $P_2$ is generated mainly at the junction face between insulative member 23 and buckling structure body 21. The axis where the moment of area of buckling structure body 21 is 0, i.e. the centroid, passes through the center of the cross section of buckling structure body 21 in the figure along the longitudinal direction. Therefore, there is deviation between the centroid and the line of action of compressive force $P_2$. Here, the line of action of compressive force $P_2$ with respect to the centroid is at the opposite side of nozzle plate 27. This causes a moment to be generated in the direction of arrow $M_2$ according to the offset between compressive force $P_2$ and the centroid. This moment acts to displace buckling structure body 21 in the direction of arrow $G_2$, i.e. towards nozzle plate 21. Buckling structure body 21 is always deformed towards nozzle plate 27 in response to this deformation caused by buckling.

According to a technical document on strength of materials, for example, "Strength of Materials" by Yoshio Ohashi (Baihukan), buckling load $P_c$ is expressed as $P_c=\pi^2Ebh^3/31^2$ in the case of a long column having both ends supported. Therefore, buckling occurs when $P>P_c$, i.e. when the temperature rise of buckling structure body 21 is greater than $\pi^2h^2/3\alpha l^2$.

More specifically, when a buckling structure body is formed of aluminum (Al) with a length of l=300 μm, a width of b=60 μm, and a thickness of h=6 μm, buckling occurs when the temperature rise is at least 45° C. When buckling structure body 21 is formed of nickel with the above-described dimension, buckling occurs at the temperature rise of at least 73° C.

Figure 6:
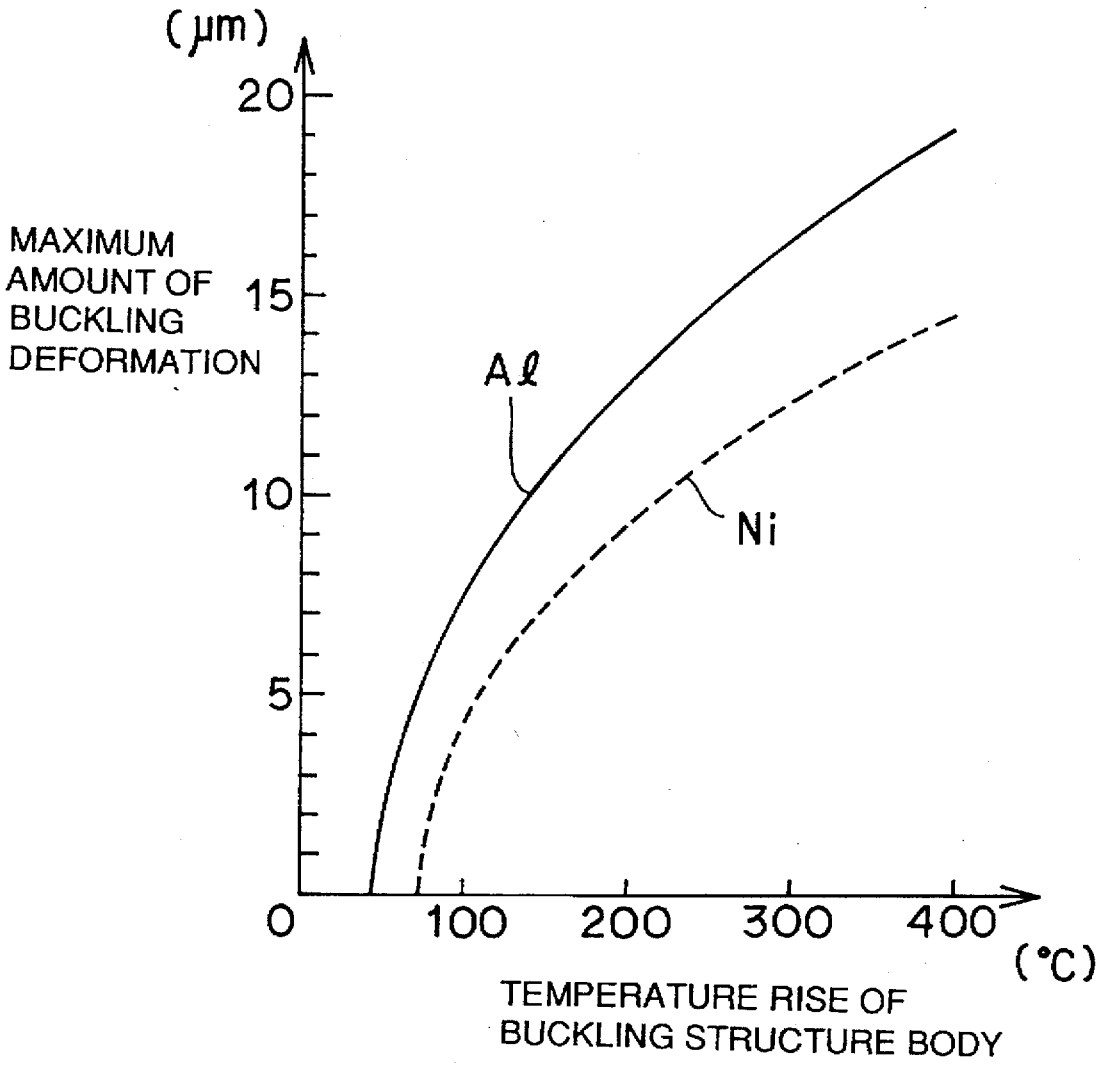
FIG. 6 is a graph showing the relationship between temperature rise of the buckling structure body and the maximum amount of buckling deformation when a predetermined metal is employed for the buckling structure body.

According to the simulation calculation shown in FIG. 6, the maximum amount of buckling deformation is 16.3 μm at a temperature rise of 300° C. with a buckling structure body 21 of aluminum of the above-described dimension. With buckling structure body 21 formed of nickel under the same condition, the maximum amount of buckling deformation is 12.2 μm.

The amount of thermal expansion in the longitudinal direction at a temperature rise of 300° C. when both ends of buckling structure body 21 is not fixed (on the basis of a room temperature of 20° C.) is 2.4 μm for aluminum and 1.5 μm for nickel. It is appreciated that the amount of buckle deformation under the same heating temperature is significantly greater than the amount of thermal expansion. That is to say, a slight amount of displacement in the longitudinal direction can be converted into a great amount of deformation in the thickness direction of buckling structure body 21.

Ink jet head 30 of the present embodiment utilizing this buckling phenomenon can convert a slight displacement in the longitudinal direction (the direction of arrow $D_2$) of buckling structure body 21 into a great amount of deformation in the thickness direction (direction of arrow $G_2$). Therefore, a great amount of displacement in the thickness direction can be obtained to provide a greater discharge force without increasing the size of buckling structure body 21.

Both ends in the longitudinal direction of buckling structure body 21 are fixed to casing 25 in order to establish buckling in buckling structure body 21. The structure thereof is extremely simple. This simple structure provides the advantage of allowing the size of ink jet head 30 of the present embodiment to be reduced. Thus, an ink jet head 30 can be realized that can provide a great discharge force while maintaining the small dimension.

It is not necessary to heat buckling structure body 21 up to a temperature at which ink itself is vaporized in ink jet head 30 of the present embodiment. In contrast to a conventional bubble type ink jet head, heating is required up to a temperature according to the coefficient of thermal expansion of the material of buckling structure body 21. It is not necessary to achieve heating to a high temperature such as 1000° C., for example, which is typical for a bubble type ink jet head, in ink jet head 30 of the present embodiment. Therefore, thermal fatigue of buckling structure body 21 caused by the repeated operation of heating to high temperature and then cooling can be suppressed. This reduces deterioration of buckling structure body 21 caused by heat fatigue, leading to increase in the lifetime thereof.

Because buckling structure body 21 has both ends supported at the back face thereof facing nozzle orifice **27*a* in ink jet head 30 of the present embodiment, buckling structure body 21 is always displaced towards nozzle orifice 27*a*. Therefore, the direction of displacement of buckling structure body 21** can be controlled with a simple structure.

The present invention is not limited to the first embodiment where buckling structure body 21 is buckled taking advantage of thermal expansion of buckling structure body 21 subjected to heating, and any method can be employed as long as buckling takes place. In other words, some external factor can be applied to buckling structure body 21 by which buckling occurs in buckling structure body 21. More specifically, buckling may be induced using a piezoelectric element.

A method of inducing buckling using a piezoelectric element will be described hereinafter as a second embodiment of the present invention.

Embodiment 2

Figure 7:
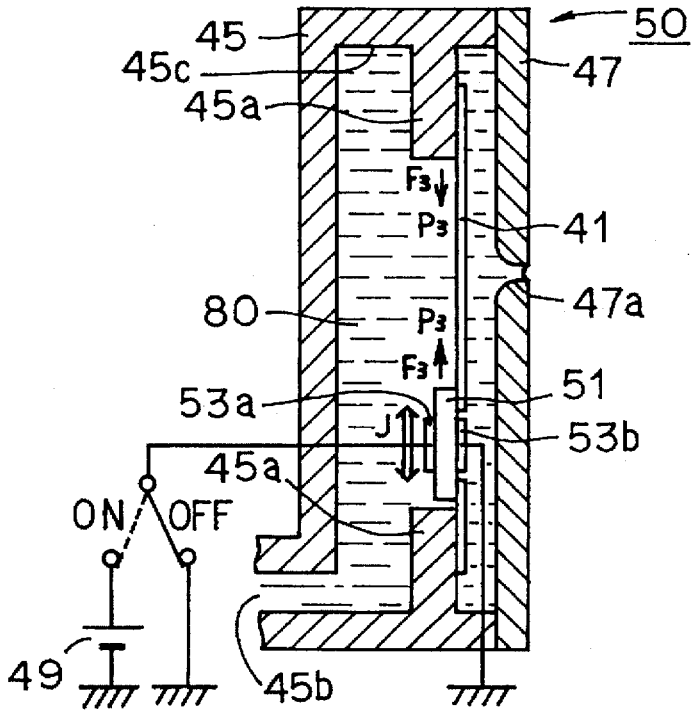
FIGS. 7 and 8 are sectional views of an ink jet head according to a second embodiment of the present invention showing a standby state and an operating state, respectively.

Referring to FIG. 7, an ink jet head 50 according to a second embodiment of the present invention includes a buckling structure body 41, a casing 45, a nozzle plate 47, a piezoelectric element 51 and a pair of electrodes **53*a* and 53*b***.

A hollow cavity is formed by casing 45 and nozzle plate 47. An ink feed inlet **45*b* for supplying ink into the hollow cavity is provided in casing 45. At the inner wall of casing 45 forming an ink current path 45*c*, a pair of attach frames 45*a* is provided extending inwards. A buckling structure body 41 is fixedly attached via piezoelectric element 51 to the pair of attach frames 45*a* at the surface facing nozzle plate 47**.

One of the ends in the longitudinal direction of buckling structure body 41 is directly fixed to attach frame **45*a*. The other end is fixedly attached to attach frame 45*a* via piezoelectric element 51**.

A pair of electrodes **53*a* and 53*b* are disposed on piezoelectric element 51 in an opposing manner so that piezoelectric element 51 is displaced at least in the direction of arrow J. One electrode 53***a* can be connected to a power source 49 via a switch. The connection/disconnection between one electrode 53*a* and power source 49 can be selected by turning on/off the switch. The other electrode 53*b* is grounded.

At the initial operation of ink jet head 50 of the second embodiment of the present invention, voltage is not applied to one electrode 53*a*. During this OFF state, ink is supplied through ink feed inlet 45*b* to fill the cavity with ink 80.

Then, the switch is turned on, whereby voltage is applied to one electrode 53*a* by power source 49 This application of voltage causes piezoelectric element 51 to expand in the direction of arrow J. By this displacement of piezoelectric element 51, compressive force $P_3$ is applied to buckling structure body 41 in the direction of arrow $F_3$. Buckling structure body 41 buckles as shown in FIG. 8 when compressive force $P_3$ exceeds the buckle load of buckling structure body 41.

Figure 8:
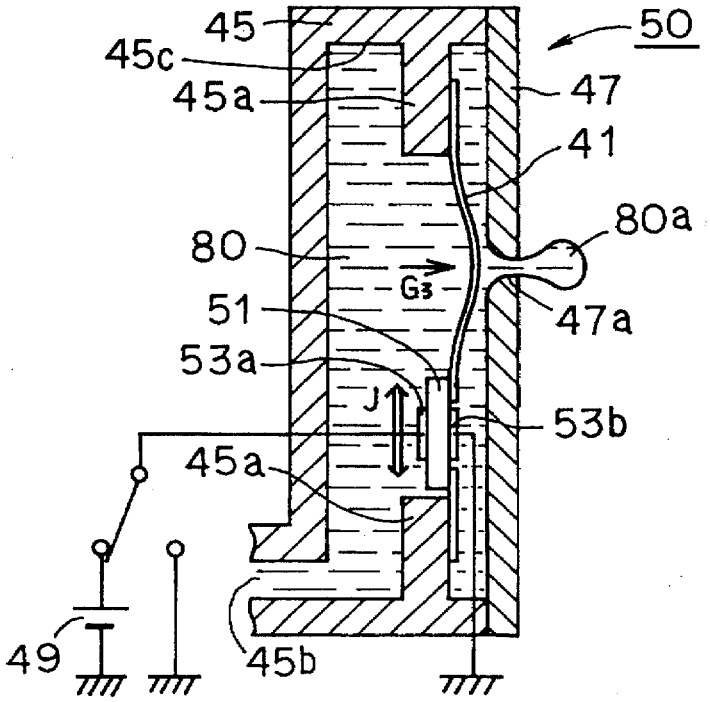

Referring to FIG. 8, buckling structure body 41 is buckled so that the center portion in the longitudinal direction of buckling structure body 41 is displaced in the direction of arrow $G_3$ (thickness direction). This displacement of buckling structure body 41 causes pressure to be exerted to ink 80 between buckling structure body 41 and nozzle plate 47. The applied pressure is propagated through ink 80, whereby ink is urged outwards via nozzle orifice 47*a*. As a result, an ink droplet 80*a* is formed outward of ink jet head 50 to be sprayed out. Thus, printing is carried out onto a print plane by ink droplets 80*a*.

In the event that the applied voltage is limited, as described before, a great amount of displacement of piezoelectric element 51 cannot be obtained. However, the present embodiment utilizes buckling deformation as in the first embodiment. This buckling deformation allows a small amount of displacement in the longitudinal direction to be converted into a great amount of displacement in the thickness direction. Therefore, the small amount of displacement in the longitudinal direction of the piezoelectric element can be converted into a great amount of displacement in the thickness direction (direction of arrow $G_3$) of bulking structure body 41. Therefore, a great amount of displacement can be obtained also in ink jet head 50 of the present embodiment without increasing the dimension as in the case where a layered type or bimorph type piezoelectric element is used. Thus, a great discharge force of ink droplets can be obtained while maintaining the small dimension of ink jet head 50 in the present embodiment.

Because both ends of buckling structure body 41 are supported at the back face that faces nozzle orifice as in the first embodiment, buckling structure body 41 is always deformed towards nozzle orifice 47*a*.

The structure of the ink jet head of the present invention is not limited to the above-described first and second embodiments in which only one surface of the ends of the buckling structure body is fixed to the casing and the ends of the buckling structure body may have both side faces sandwiched.

A structure where both ends of a buckling structure body are supported in a sandwiched manner will be described hereinafter as a third embodiment of the present invention.

Embodiment 3

Figure 9:
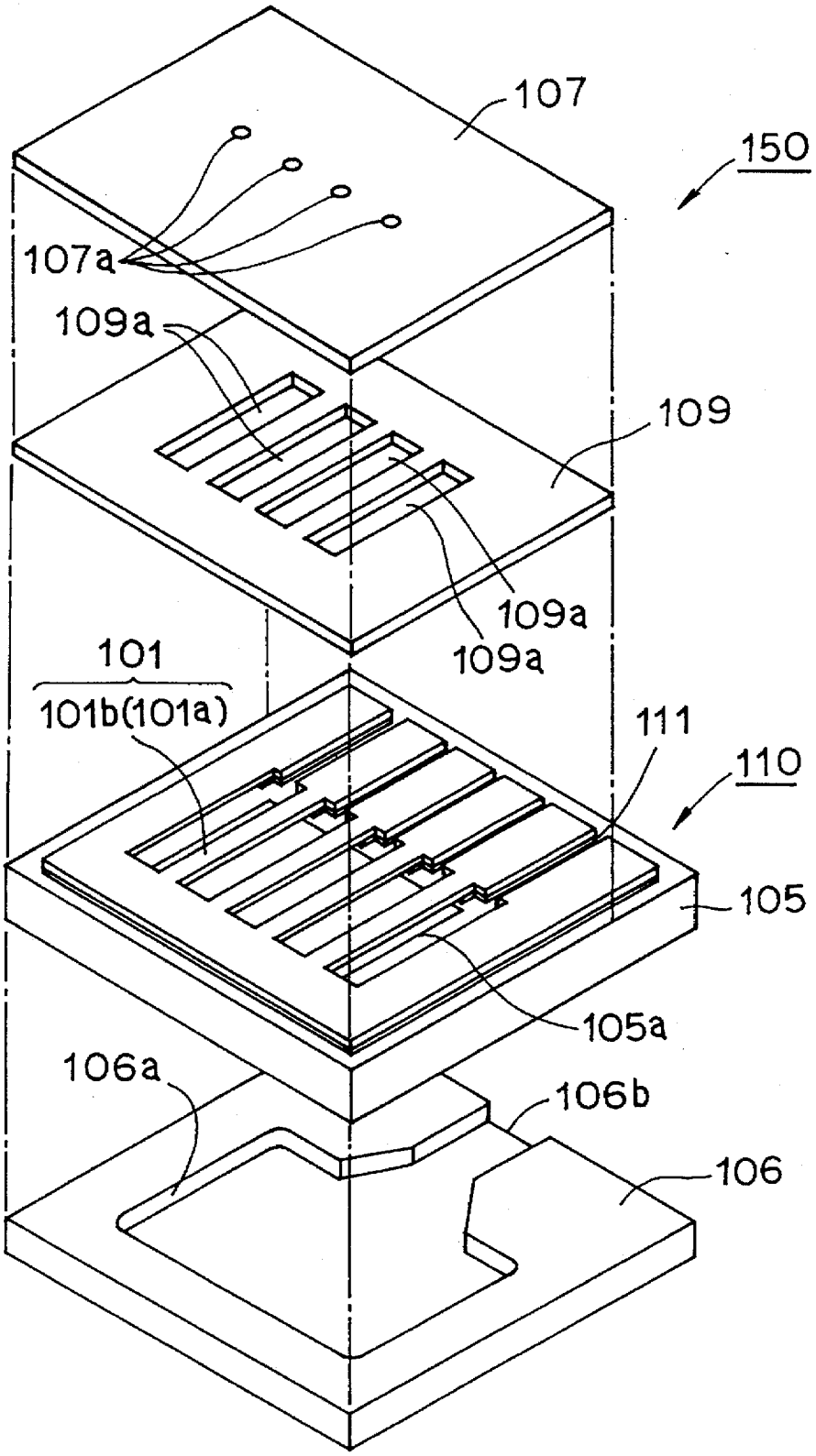
FIG. 9 is an exploded perspective view of an ink jet head according to a third embodiment of the present invention.

Referring to FIG. 9, an ink jet head 150 according to a third embodiment of the present invention includes an ink cover 106, a nozzle plate 107, a cavity 109, and a casing 110.

Figure 10:
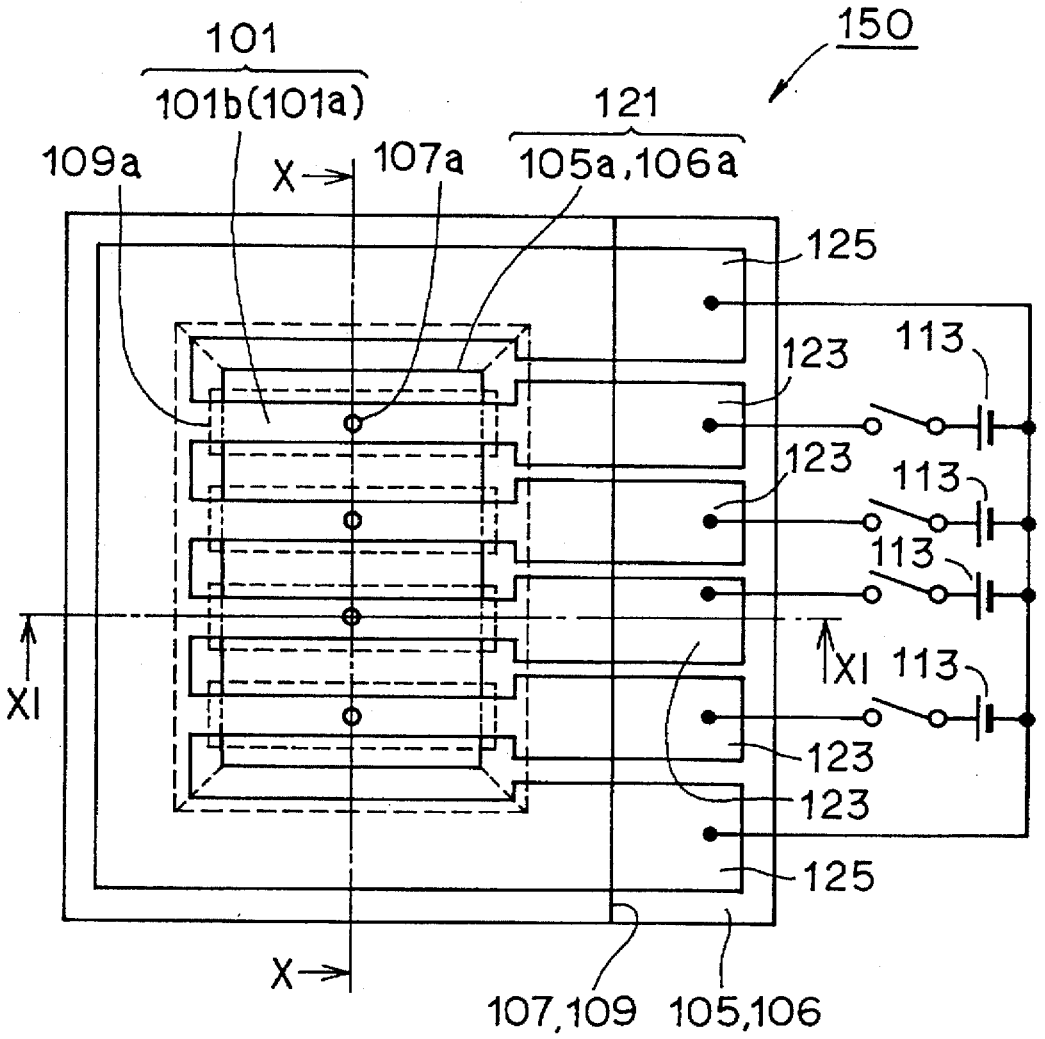
FIG. 10 is a plan view schematically showing a structure of the ink jet head according to the third embodiment of the present invention.

Referring to FIGS. 9 and 10, nozzle plate 107 has a thickness of approximately 0.1 mm, for example, and is formed of a glass material. A plurality of nozzle orifices 107*a* piercing nozzle plate 107 are arranged in a predetermined direction. A nozzle orifice 107*a* is formed in nozzle plate 107 in a conical or funnel-like configuration by etching with hydrofluoric acid.

Cavity 109 is formed of a stainless steel plate having a thickness of 20–50 μm, for example. In cavity 109, a plurality of openings 109*a* forming a pressure chamber is provided penetrating cavity 109. The plurality of openings 109*a* are provided corresponding to the plurality of nozzle orifices 107*a*. Opening 109*a* is formed by a punching operation.

A casing 110 includes a substrate 105, a plurality of buckling structure bodies 101, and an insulative member 111. A tapered concave portion 105*a* is provided piercing substrate 105. The plurality of buckling structure bodies 101 are provided on one surface of substrate 105 with an insulative member 111 therebetween. Each buckling structure body 101 is provided corresponding to each nozzle orifice 107*a*. A pilot electrode 123 and a common electrode 125 are drawn out from each buckling structure body 101 for connection with an external electric means. Pilot electrode 123 and common electrode 125 are fixedly provided on substrate 105 by insulative member 111. Current flows from power source 113 to each pilot electrode 123 via a switch.

Each buckling structure body 101 has a two layered structure of a thick film layer 101*a* and a thin film layer 101*b*. Thick film layer 101*a* is located closer to substrate 105 than thin film layer 101*b*. Thick film layer 101*a* is formed of a material having a coefficient of linear expansion smaller than that of thin film layer 101*b*. Thick film layer 101*a* is formed of, for example, polycrystalline silicon (coefficient of linear expansion: $2.83\times10^{-6}$) of 4.5 μm in thickness. Thin film layer 101*b* is formed of, for example, aluminum (coefficient of linear expansion: $29\times10^{-6}$) of 0.5 μm in thickness.

Substrate 105 is formed of a single crystalline silicon substrate of a plane orientation of (100).

A concave portion 106*a* of a predetermined depth is provided at the surface of ink cover 106. A portion 106*b* communicates with one side of ink cover 106 which becomes an ink feed inlet.

Figure 11:
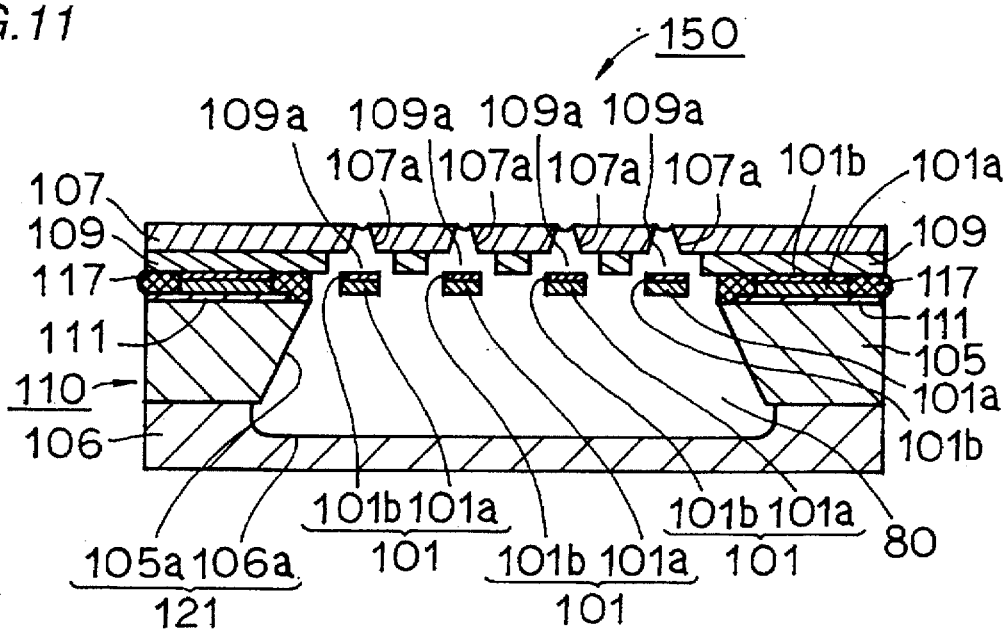
FIGS. 11 and 12 are sectional views taken along lines X—X and XI—XI, respectively, of FIG. 10.
Figure 12:
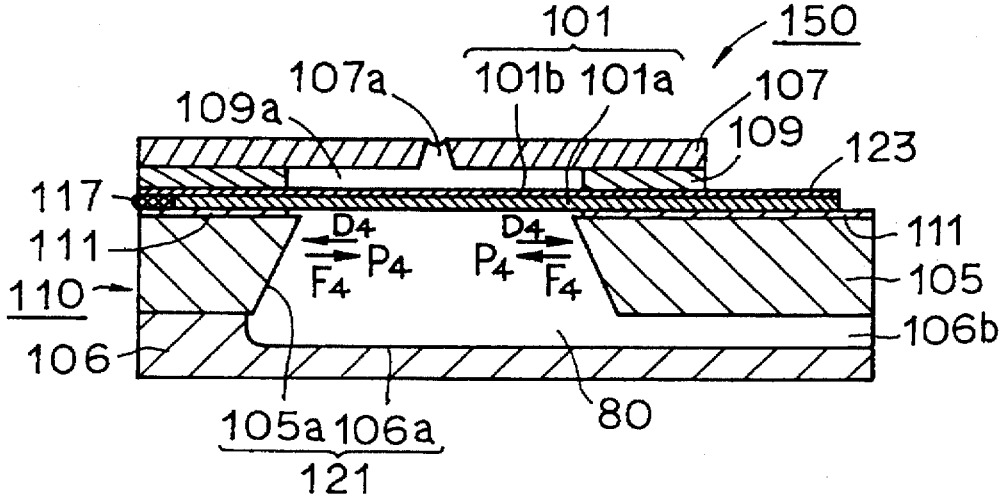

Referring to FIGS. 11 and 12, nozzle plate 107 is bonded to casing 110 by a non-conductive epoxy adhesive agent 117 via cavity 109. Nozzle plate 107, cavity 109, and casing 110 are arranged so that buckling structure bodies 101*a* and 101*b* come directly beneath each nozzle orifice 107*a* via each opening 109*a*. Thus, each opening 109*a* forms a cavity through which buckling structure bodies 101*a* and 101*b* apply pressure to ink, i.e. forms a pressure chamber.

Ink cover 106 is fixedly attached to casing 110 by an epoxy type adhesive agent (not shown). Here, an ink chamber 121 is formed by a tapered concave unit (ink flow path) 105*a* provided in casing 110 and a concave portion 106*a* provided in ink cover 106. Ink feed inlet 106*b* is provided so as to communicate with ink chamber 121. Ink 80 is supplied to ink chamber 121 from an external ink tank layer (not shown) through ink feed inlet 106*b*.

A continuous cavity is formed by ink chamber 121 and pressure chamber 109*a* by arrangement of the above-described components. Ink can be supplied to ink chamber 121 via ink feed inlet 106*b*. Ink can be discharged and sprayed outwards from pressure chamber 109*a* via nozzle orifice 107*a*.

For the sake of simplicity, the present embodiment is described of a multinozzle head having 4 nozzle orifices 107*a*. The ink jet head of the present invention is not limited to this number of nozzle orifices 107*a*, and an arbitrary number thereof can be designed.

A method of manufacturing casing 110 in particular will be described of ink jet head 150 of the present embodiment.

Figure 13:
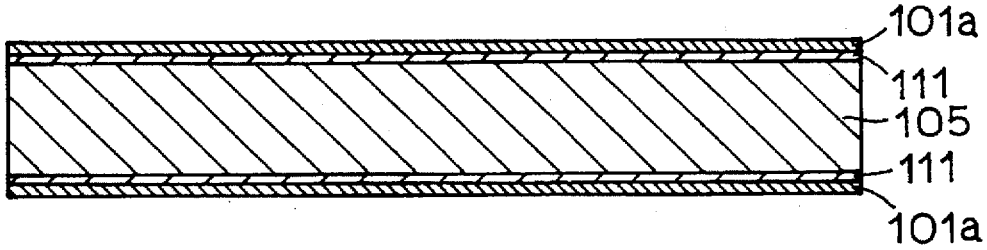
FIGS. 13–18 are sectional views of the ink jet head according to the third embodiment of the present invention sequentially showing the steps of manufacturing a casing thereof.

Referring to FIG. 13, a substrate 105 is prepared formed of single crystalline silicon of a plane orientation of (100). Silicon oxide ($SiO_2$) 111 including 6–8% phosphorus (P) (referred to as PSG (Phospho-Silicate Glass) hereinafter) is formed by a LPCVD device to a thickness of 2 μm, for example, on both faces of substrate 105. Then, a polycrystalline silicon layer 101*a* that does not include impurities is grown to a thickness of approximately 4.5 μm by a LPCVD device on respective PSG layers 111. Next, an annealing step is carried out for approximately 1 hour in a nitride ambient an electric furnace of approximately 1000° C. During this annealing process, phosphorus from PSG layer 111 diffuses into polycrystalline silicon layer 101*a*. Therefore, polycrystalline silicon layer 101*a* is made conductive.

For the sake of simplicity, the upper side of substrate 105 is referred to as the surface, and the lower side of substrate 105 is referred to as the back face in the drawing.

Figure 14:
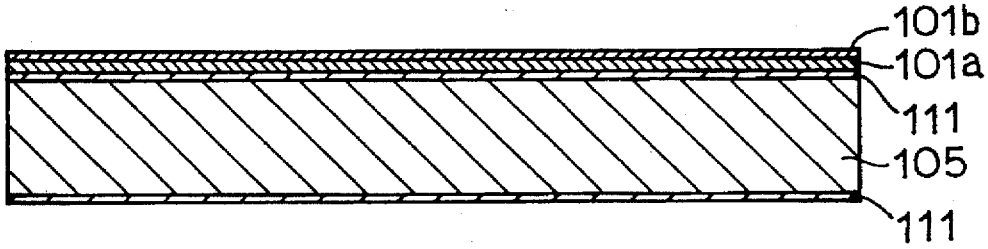

Referring to FIG. 14, polycrystalline silicon layer 101*a* at the back face of substrate 105 is removed by etching. An aluminum layer 101*b* is grown to a thickness of 0.5 μm by a sputtering device on polycrystalline silicon layer 101*a* at the surface of substrate 105. Then, aluminum layer 101*b* and polycrystalline silicon layer 101*a* are etched by a dry etching device.

Figure 15:
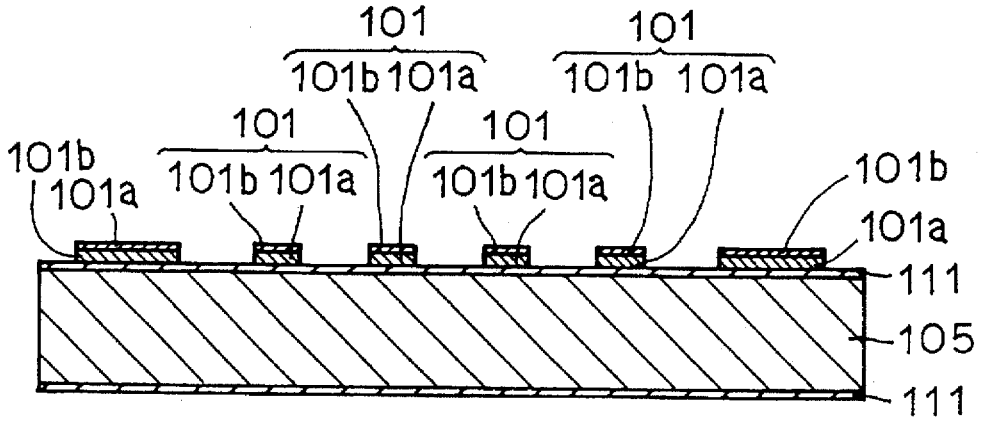

By this etching process, aluminum layer 101*b* and polycrystalline silicon layer 101*a* are patterned to a desired configuration as shown in FIG. 15. Thus, a buckling structure body 101 of aluminum layer 101*b* and polycrystalline silicon layer 101*a* is formed.

Figure 16:
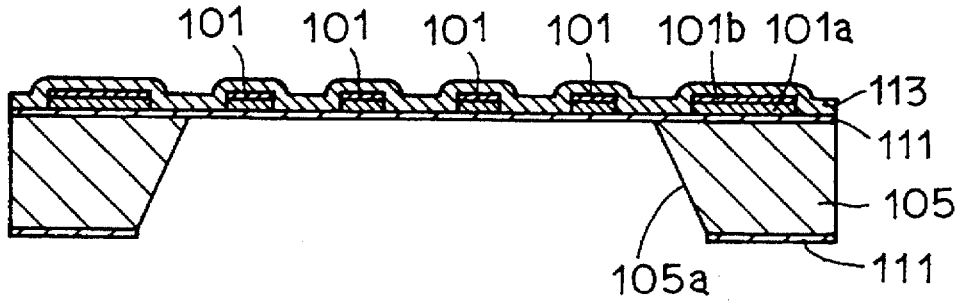

Referring to FIG. 16, polyimide 113 is applied by a spin coater to protect patterns 101*a*, 101*b* on the surface of substrate 105. PSG layer 111 at the back face of substrate 105 is also patterned. Using this patterned PSG layer 111 as a mask, silicon substrate 105 is etched with an EDP liquid (including ethylenediamine, pyrocatechol and water) which is an anisotropic etching liquid. By this etching process, a tapered concave portion 105*a* penetrating silicon substrate 105 is formed. Then, PSG layer 111 at the back face of silicon substrate 105 is etched away.

Figure 17:
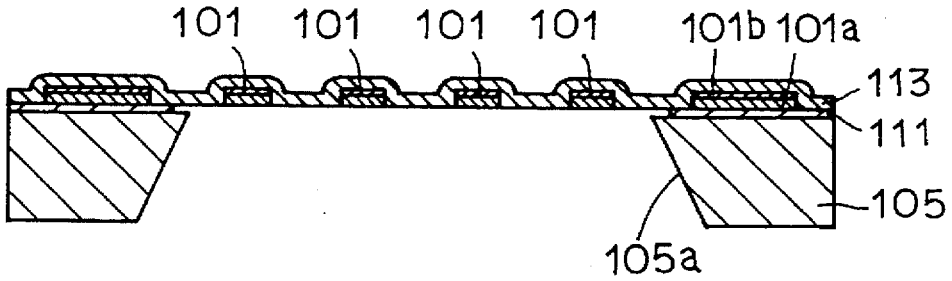
Figure 18:
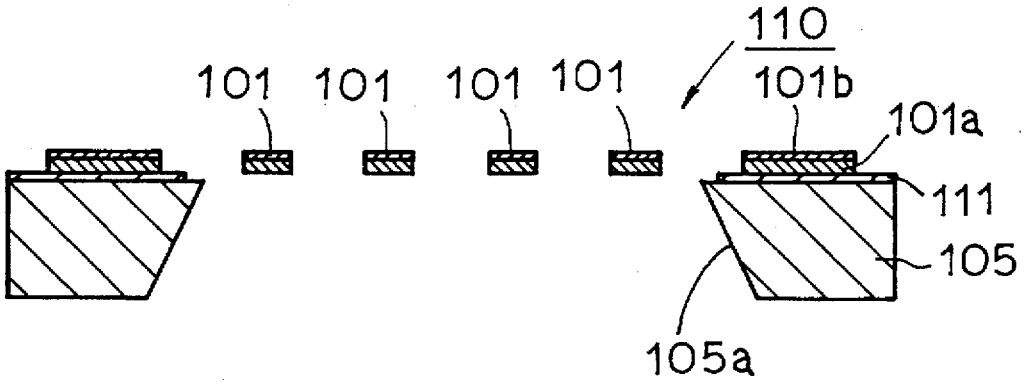

Referring to FIG. 17, PSG layer 111 on the back face of substrate 105 is partially removed together with the removal of PSG layer 111 at the back face of silicon substrate 105. Finally, polyimide 113 is etched away to result in casing 110 having a desired structure as shown in FIG. 18.

The operation of ink jet head 150 according to the third embodiment of the present invention will be described hereinafter.

Referring to FIGS. 11 and 12, ink 80 is supplied from an external ink tank via ink feed inlet 106*b*, whereby ink chamber 121 and pressure chamber 109*a* are filled with ink 80. Then, current flows to pilot electrode 123 and common electrode 125 by operation of the switch shown in FIG. 10. This causes buckling structure body 101*a* and 101*b* to be heated by resistance heating, whereby thermal expansion is to take place at least in the longitudinal direction. However, buckling structure body 101 has both ends in the longitudinal direction fixed to substrate 105 via insulative member 111. Therefore, buckling structure body 101 cannot establish expansion deformation in the longitudinal direction (the direction of arrow $D_4$). As a reactive force thereof, compressive force $P_4$ is generated in the direction of arrow $F_4$ to be accumulated in buckling structure body 101. When the temperature of buckling structure body 101 is raised so that compressive force $P_4$ exceeds the buckle load, buckling deformation occurs in buckling structure body 101 as shown in FIG. 19.

Figure 19:
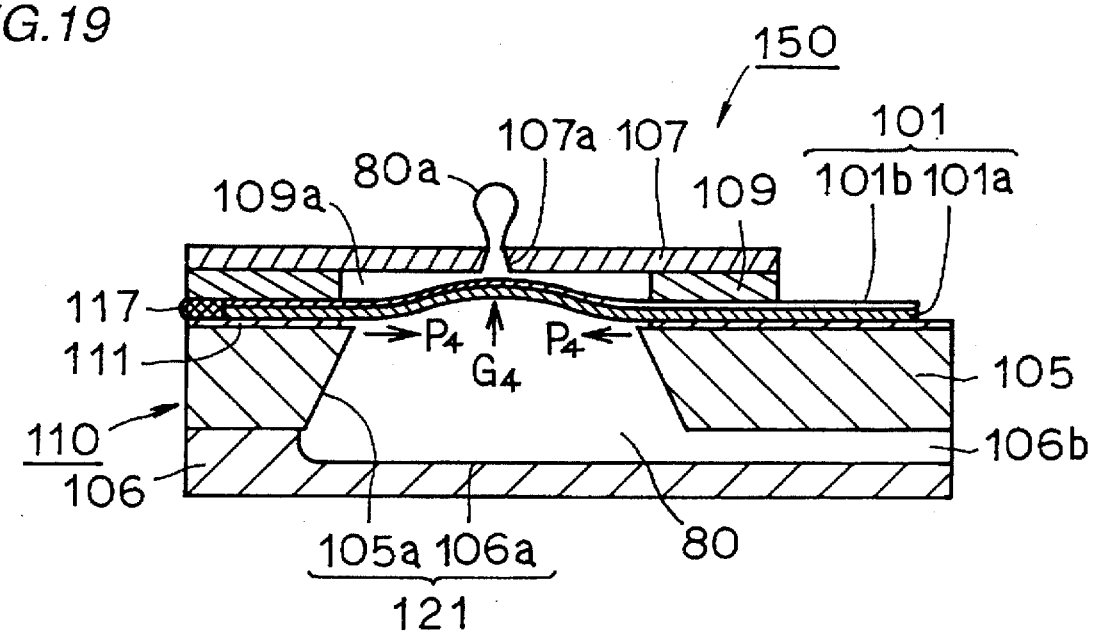
FIG. 19 is a sectional view of the ink jet head according to the third embodiment of the present invention schematically showing an operating state thereof.

Referring to FIG. 19, buckling deformation of buckling structure body 101 causes the center portion in the longitudinal direction to be displaced constantly towards arrow $G_4$. By buckling deformation of buckling structure body 101, pressure is exerted to ink 80 so that into pressure chamber 109*a*. This pressure is propagated through ink 80, whereby ink 80 is urged outwards through nozzle orifice 107*a*. Ink 80 pushed outwards forms an ink droplet 80*a* outside ink jet head 150 to be sprayed out. Thus, printing to a printing plane is carried out by the sprayed out ink droplet 80*a*.

Buckling structure body 101 of ink jet head 150 of the present embodiment has the center portion in the longitudinal direction displaced in a predetermined direction (the direction of arrow $G_4$) by buckling deformation. The reason why the center portion is displaced towards a predetermined direction will be described in detail hereinafter.

According to ink jet head 150 of the present embodiment, buckling structure body 101 has a two layered structure of a thick film layer 101*a* and a thin film layer 101*b*. Thick film layer 101*a* is formed of a material having a coefficient of linear expansion smaller than that of thin film layer 101*b*. When buckling structure body 101 entirely is raised to a predetermined temperature, the amount of thermal expansion of thin film layer 101*b* becomes greater than that of thick film layer 101*a*. By difference in the amount of thermal expansion of the two layers, buckling structure body 101 is deformed towards the nozzle plate 107 side which is lower in resistance.

The above-described thin film layer 101*b* has an amount of thermal expansion greater than that of thick film layer 101*a*, and the expanding force towards the longitudinal direction is greater in thin film layer 101*b*. When buckling structure body 101 is displaced in the direction of arrow $G_4$, thin film layer 101*b* is deformed at a curvature relatively greater than that of thick film layer 101*a*. Even if the expanding force of thin film layer 101*b* is greater than that of thick film layer 101*a*, the inner compressive stress which is a reactive force thereof is relaxed by deformation at a greater curvature.

In contrast, when buckling structure body 101 is displaced in a direction opposite to the direction of arrow $G_4$, thin film layer 101*b* is deformed at a curvature smaller than that of thick film layer 101*a*. In this case, the amount of relaxation of internal compressive stress in thin film layer 101*b* is lower than in the case of displacement in the direction of arrow $G_4$. Therefore, the resistance in buckling structure body 101 is increased, whereby buckling structure body 101 is displaced towards nozzle plate 107. It is therefore possible to control the bulking of buckling structure body 101 to be displaced constantly in a predetermined direction. Thus, erroneous operation of an ink jet head is prevented.

Because the ends of the buckling structure body 101 is supported so as to be sandwiched between nozzle plate 107 and substrate 105, effects set forth in the following are obtained.

When a plurality of buckling structure bodies 101 are arranged to form a multinozzle, deformation (warp) is generated in substrate 105 if low in thickness (for example, approximately 500 μm when using a silicon substrate) due to a reactive force from buckling structure body 101 when a plurality of buckling structure bodies 101 are actuated at one time. This deformation of substrate 105 attenuates the force generated in buckling structure body 101.

However, deformation of substrate 105 is suppressed by virtue of the structure where both ends of buckling structure body 101 are supported by being sandwiched between substrate 105 and nozzle plate 109. This prevents the force generated at buckling structure body 101 from being attenuated.

In ink jet head 150 of the present embodiment, both ends of buckling structure body 101 are supported so as to be sandwiched by substrate 105 and nozzle plate 107. This reduces the probability of the buckling structure body from coming off the supporting member in comparison with the case where only one surface of both ends of the buckling structure body is supported.

In general, the stress generated by deformation caused by buckling of a bucking structure body is most greatly exerted on the portion where the buckling structure body is supported to substrate 105. There is a possibility of the buckling structure body repeatedly deformed at high speed being detached from the supporting portion when both ends of the buckling structure body is supported only by one side surface.

If both ends of the buckling structure body 101 are supported having both sides thereof sandwiched, stress generated by deformation of the buckling structure body is dispersed towards the interface of the supporting member at either sides to further strengthen the supporting force. This reduces the possibility of the detachment of the buckling structure body. Thus, ink jet head 150 of the present invention is extremely superior in endurance.

In ink jet head 150 of the present embodiment, thick film 101*a* is considerably greater in thickness than thin film layer 101*b* of the buckling structure body. Calculating the buckling characteristics of the buckling structure body with the mechanical characteristics of polycrystalline silicon forming thick film layer 101*a*, buckling occurs in the buckling structure body at a temperature of at least 147° C. with the dimension of the length l=400 μm, the width b=60 μm, and the thickness h=4.5 μm. Calculating by a more detailed simulation the maximum amount of buckling deformation when the temperature of the buckling structure body rises is 5.4 μm at the temperature of 300° C.

The amount of thermal expansion in the direction of the length at the temperature of 300° C. (based on the room temperature of 20° C.) when both ends of the buckling structure body are not fixed is 0.17 μm with polycrystalline silicon. It is therefore appreciated that the amount of displacement is significantly greater in the present buckling deformation in which the displacement amount in the longitudinal direction is converted in the displacement amount in the thickness direction in comparison with the case where displacement is induced in the longitudinal direction by thermal expansion. By taking advantage of this buckling phenomenon, a great amount of deformation can be obtained in the thickness direction.

Buckling structure body 101 is not limited to a two layered structure of a thick film layer 101*a* and a thin film layer 101*b* in ink jet head 150 of the present embodiment, and a structure of more than two layers may be used.

Thick film layer 101*a* and thin film layer 101*b* of buckling structure body 101 are formed of materials differing in the coefficient of linear expansion. The buckling direction of buckling structure body 101 is controlled by this difference. However, the present invention is not limited to this structure for controlling the buckling direction in ink jet head 150, and a similar result can be obtained by using a material with almost no internal compressive stress for thick film layer 101*a*, and by using a material of great internal compressive stress, for example, a silicon oxide layer grown by a sputtering device for thin film layer 101*b* of the two layered structure.

It is also possible to apply internal stress in advance in buckling structure body 21 shown in FIG. 3, and control the temperature at which buckling occurs in the buckling structure body by controlling the internal stress. This will be described in detail hereinafter.

Referring to FIG. 5A, buckling structure body 21 has a modulus of direct elasticity of $E(N/m^2)$, a coefficient of linear expansion of $\alpha$, a length of l(m), a width of b(m), and a thickness of h(m). The internal stress set in buckling structure body 21 is $\sigma$(Pa). Assuming that $\sigma$ is a value at the room temperature of 20° C. the signs of $\sigma$ are +and−when the internal stress is a compressive stress and a tensile stress, respectively. Assuming that the temperature is raised by T° C. from the room temperature of 20° C., compressive force $P_2$ is expressed as $(E\alpha T+\sigma)bh(N)$. Buckling occurs in buckling structure body 21 when compressive force $P_2$ exceeds buckle load $P_c$, whereby the portion substantially at the center in the longitudinal direction of buckling structure body 21 is displaced in the direction of arrow $G_2$.

In the case of a long column having both ends supported as described above, buckling load $P_c=\pi^2Ebh^3/3l^2$. Therefore, the temperature $T_c$ at which buckling occurs by $P>P_c$ (referred to as "buckling temperature" hereinafter) is $(\pi^2h^2/3\alpha l^2)-(\sigma/E\alpha)$.

When an internal stress is applied in advance in buckling structure body 21 at the room temperature (20° C.), the buckling temperature becomes lower by $\sigma/E\alpha$ in comparison with the case where an internal stress is not applied. More specifically, buckling temperature $T_c$ can be reduced as the internal stress $\sigma$ applied to buckling structure body 21 at room temperature becomes greater.

For example, in a buckling structure body 21 formed of nickel (Ni) with the dimension of 300 μm in length l, 60 μm in width b, and 6 μm in thickness h, buckling occurs at the temperature rise of 73° C. in buckling structure body 21 when the internal stress $\sigma$ at room temperature is 0 (Pa). When the internal stress $\sigma$ at room temperature is set to 50 MPa (compressive stress) in a buckling structure body of the same material and dimension, buckling occurs in buckling structure body 21 when the temperature rise in buckling structure body 21 becomes 49° C.

Figure 20:
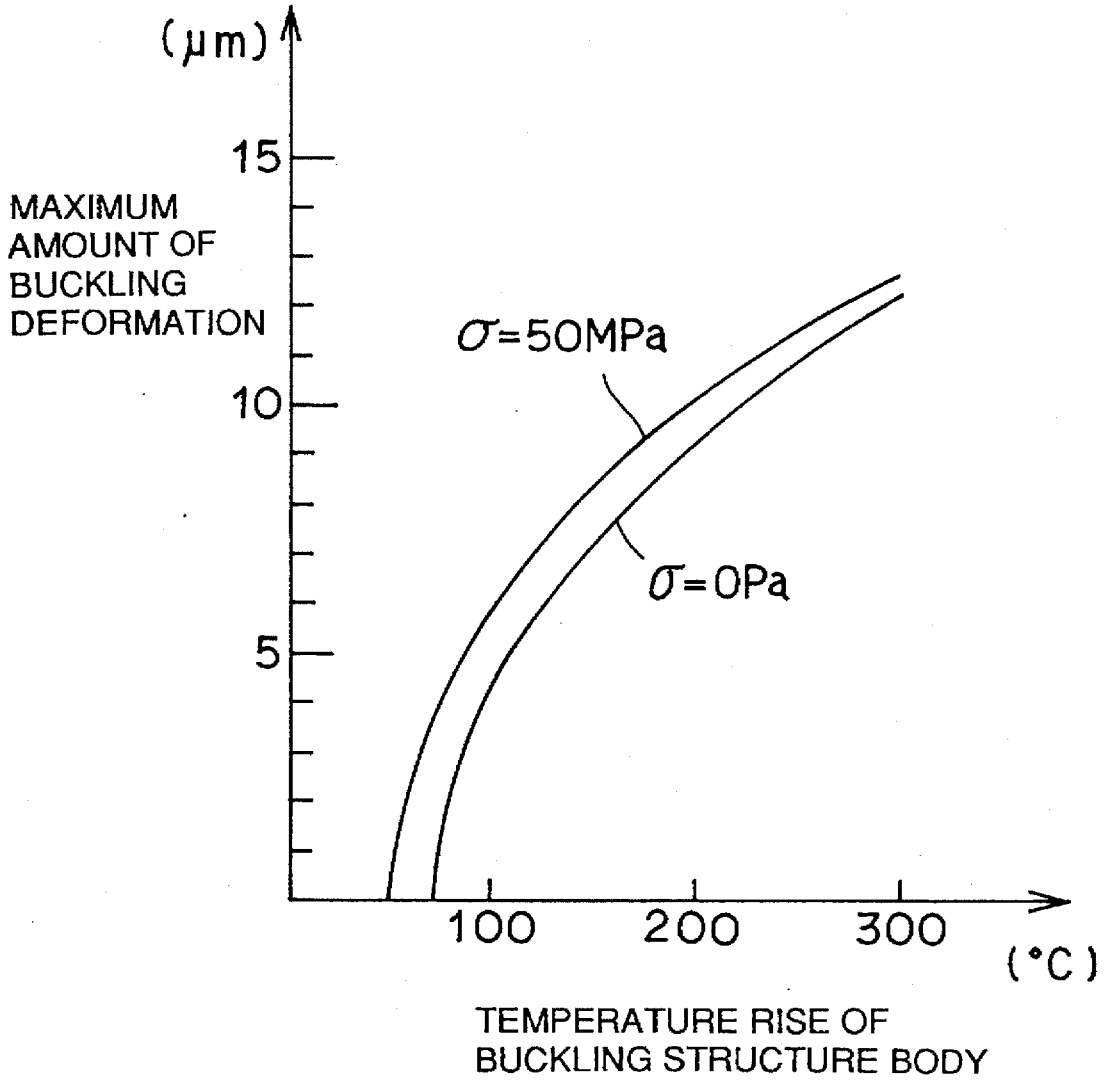
FIG. 20 is a graph showing the relationship between temperature rise and the maximum amount of buckling deformation of the buckling structure body when the internal stress of the internal stress of the buckling structure body is varied.

The graph of FIG. 20 has the temperature rise of the buckling structure body plotted along the abscissa and the maximum amount of buckling deformation plotted along the ordinate. $\sigma$=0 Pa shows the case where the internal stress in the buckling structure body at room temperature (20° C.) is 0, and $\sigma$=50 MPa shows the case where the compressive stress of 50 MPa is added to the buckling structure body at room temperature. When internal stress $\sigma$ is not added at room temperature, a deformation amount of 9.2 μm is generated at the temperature rise of 200° C. of the buckling structure body. When a compressive stress of 50 MPa is added at room temperature, a deformation amount of 10.1 μm is obtained at the temperature rise of 200° C. of the buckling structure body.

It is therefore appreciated that a greater amount of buckling deformation can be obtained by adding an internal stress in advance at room temperature. Thus, the discharge force for discharging ink can be increased in an ink jet head.

A specific structure of an ink jet head realizing the above mechanism will be described hereinafter as the fourth embodiment of the present invention.

Embodiment 4

Figure 21:
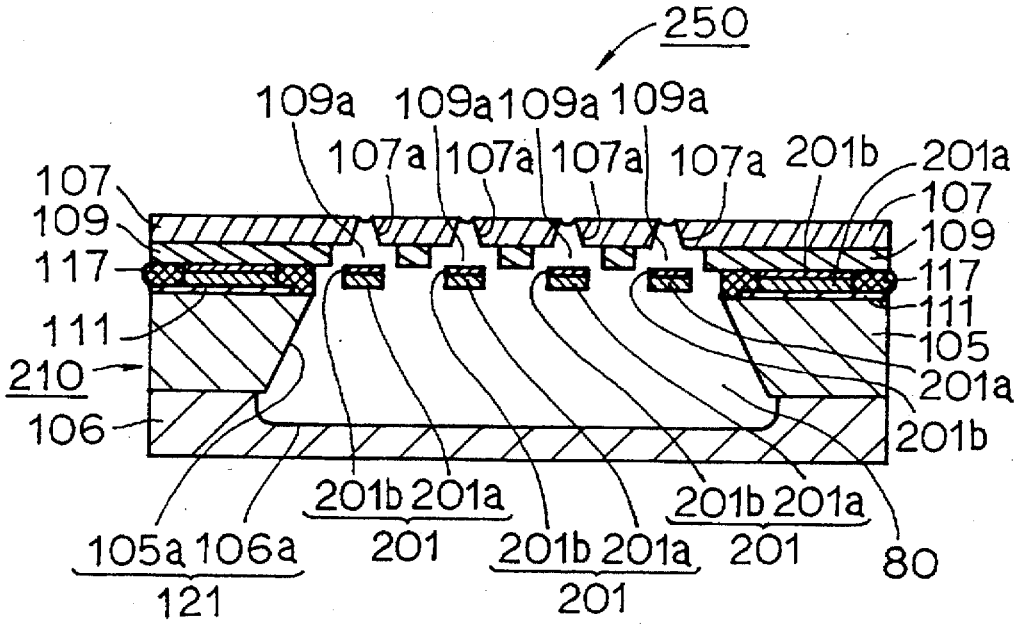
FIGS. 21 and 22 are sectional views of an ink jet head according to a fourth embodiment of the present invention corresponding to the sectional views taken along lines X—X and XI—XI, respectively, of FIG. 10.
Figure 22:
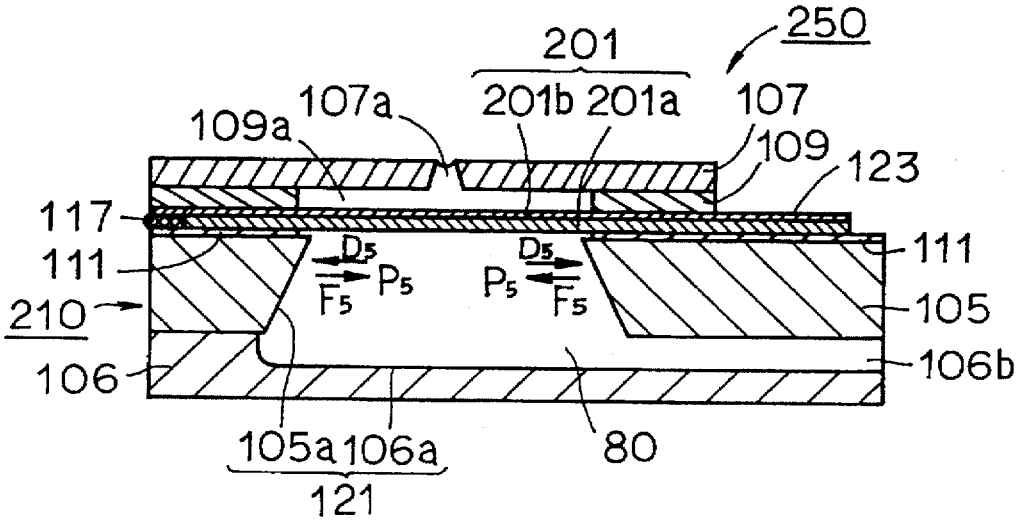

An ink jet head 250 of the present embodiment shown in FIGS. 21 and 22 differs from ink jet head 150 of the third embodiment in the structure of casing 110. The structure of buckling structure body 201 particularly of casing 210 differs from that of the third embodiment.

More specifically, ink jet head 250 of the present invention includes a buckling structure body 201 of a double layered structure of a thick film layer 201*a* and a thin film layer 201*b*. Thick film layer 201*a* and thin film layer 201*b* have different compressive forces in the room temperature. In other words, the compressive stress of thick film layer 201*a* is set lower than that of thin film layer 201*b*. Thick film layer 201*a* and thin film layer 201*b* are formed of, for example, nickel.

The other elements of ink jet head 250 of the present embodiment is similar to those of ink jet head 150 of the third embodiment and their description will not be repeated.

A method of manufacturing particularly casing 210 in ink jet head 250 of the fourth embodiment will be described hereinafter.

Figure 23:
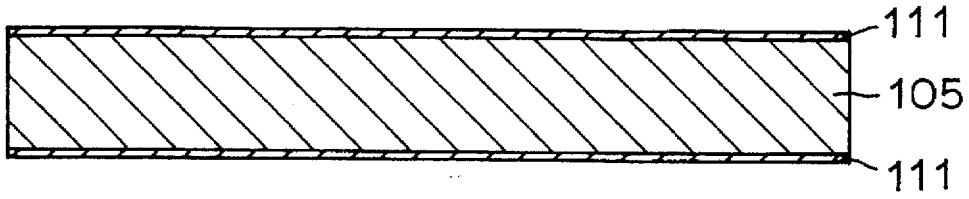
FIGS. 23–29 are sectional views of the ink jet head according to the fourth embodiment of the present invention showing sequential steps of manufacturing a casing thereof.
Figure 24:
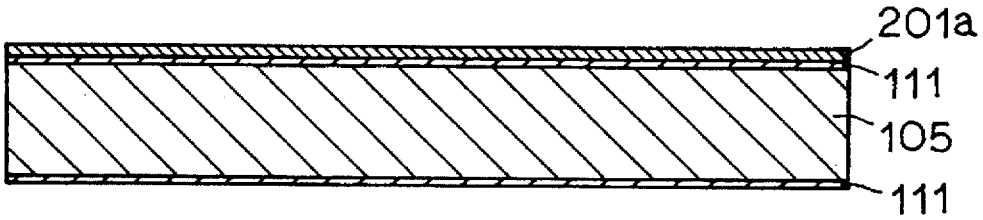

Referring to FIG. 23, a single crystalline silicon substrate 105 of a plane orientation of (100) is prepared. Silicon oxide ($SiO_2$) 111 including 6–8% of phosphorus (P) is grown to a thickness of 2 μm, for example, by a LPCVD device at both faces of substrate 105. Then, a plated underlying film (not shown) of nickel is formed to a thickness of 0.09 μm, for example, by a sputtering device on one PSG layer 111. Referring to FIG. 24, a thick nickel layer 201*a* having a predetermined compressive internal stress is grown to a thickness of 5.5 μm, for example, on the surface of the plated underlying film by electroplating technique.

For the sake of simplification, the upper face in the drawing of substrate 105 is referred to as the surface, and the lower face is referred to as the back face.

Figure 25:
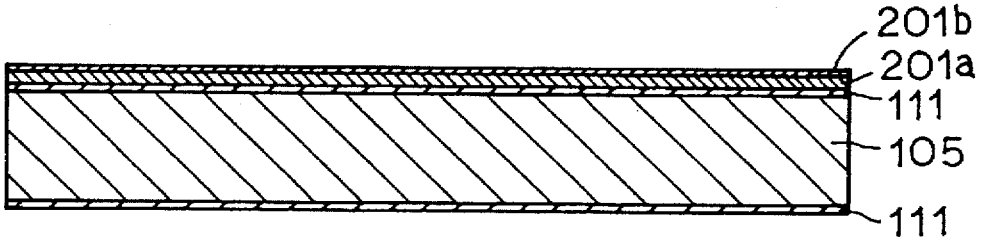

Referring to FIG. 25, a thin nickel layer 201*b* having a compressive internal stress greater than that of thick nickel layer 201*a* is grown to a thickness of 0.5 μm, for example, on the surface of thick nickel layer 201*a* by electroplating technique.

Electroplating techniques for forming thick and thin nickel layers 201*a* and 201*b* will be described in detail hereinafter.

Figure 30:
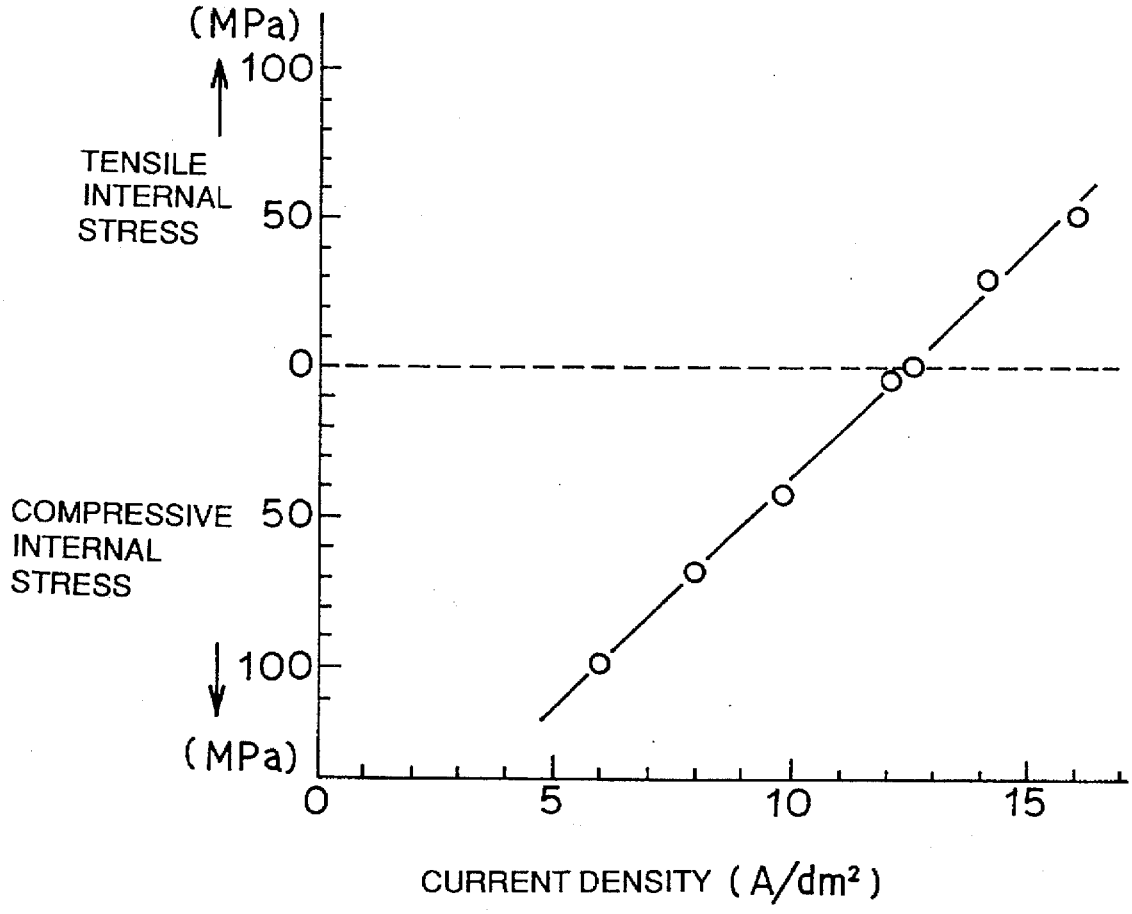
FIG. 30 is a graph showing the relationship between the internal stress and current density of nickel formed by electroplating.

Using an electrolytic bath of nickel plating of sulfamic acid nickel: 600 g/l, nickel chloride: 5 g/l, and boric acid: 30 g/l with the bath temperature set to 60° C., the relationship between the internal stress of the electroplated coating and current density is shown in FIG. 30.

In the graph of FIG. 30, current density is plotted along the abscissa, and the internal stress of the nickel layer is plotted along the ordinate. In forming thick nickel layer 201*a* and thin nickel layer 201*b* with compressive stresses of 50 MPa and 70 MPa, respectively, electroplating is initiated at the current density of 9A/dm$^2$ to form thick nickel layer 201*a* to a predetermined thickness. The current density is then switched to 7.8A/dm$^2$ to form thin nickel layer 201*b* to a predetermined thickness.

Figure 26:
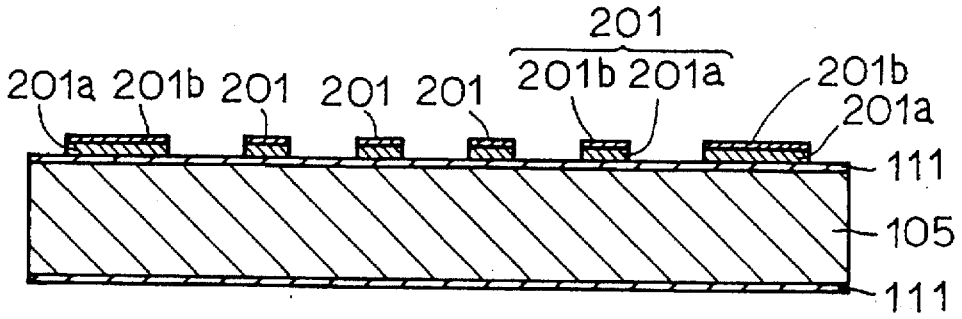

Referring to FIG. 26, thick coated layer 201*a* and thin coated layer 201*b* formed by the above-described conditions are etched to be patterned to a desired configuration.

Figure 27:
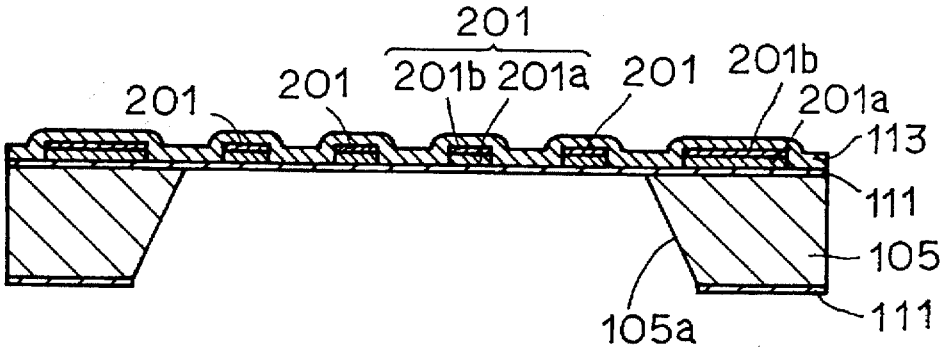

Referring to FIG. 27, polyimide 113 is applied by a spin coater on the surface of substrate 105 so as to provide protection for patterns 201*a* and 201*b*. PSG layer 111 at the back face of substrate 101 is patterned. Using this patterned PSG layer 111 as a mask, silicon substrate 105 is etched with an EDP liquid which is an anisotropic etching liquid. As a result of this etching process, a concave portion 105*a* of a tapered configuration piercing silicon substrate 105 is formed. Then, PSG layer 111 at the back face of silicon substrate 105 is removed by etching.

Figure 28:
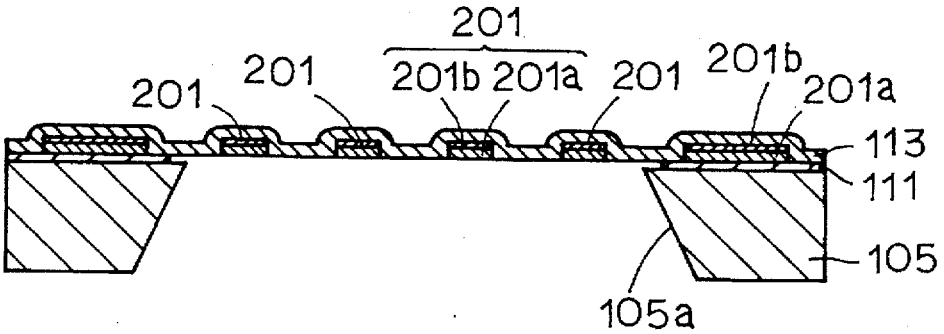
Figure 29:
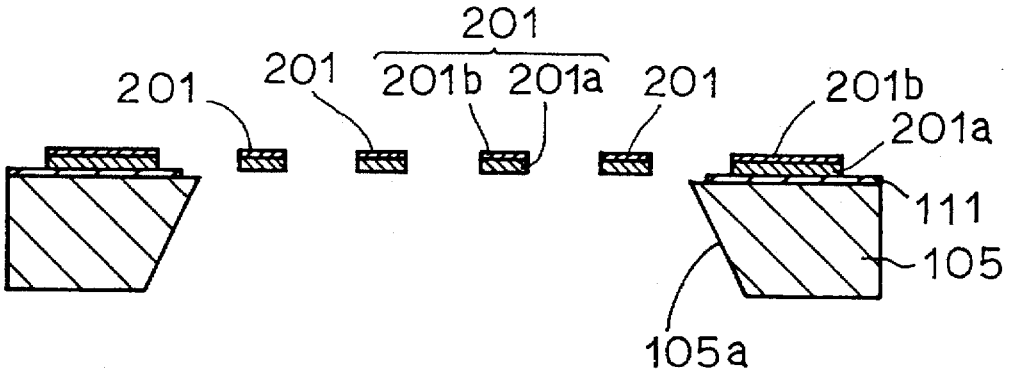

Referring to FIG. 28, PSG layer 111 at the surface of silicon substrate 105 is also partially removed with the etching step of PSG layer 111 at the back face of silicon substrate 105. Finally, polyimide 113 is etched away to result in a casing 210 having a desired structure as shown in FIG. 29.

The operation of ink jet head 250 of the fourth embodiment of the present invention is similar to the operation described in the third embodiment. It is to be noted that a compressive internal stress is applied in advance to thick nickel layer 201*a* and thin nickel layer 201*b* forming buckling structure body 201. If buckling is to be generated by heating in buckling structure body 201, the buckling temperature is lower than that of the third embodiment. It has been confirmed by experiments that the required power consumption for obtaining a desired ink discharge force is reduced by 12% in comparison with that of the third embodiment.

Figure 31:
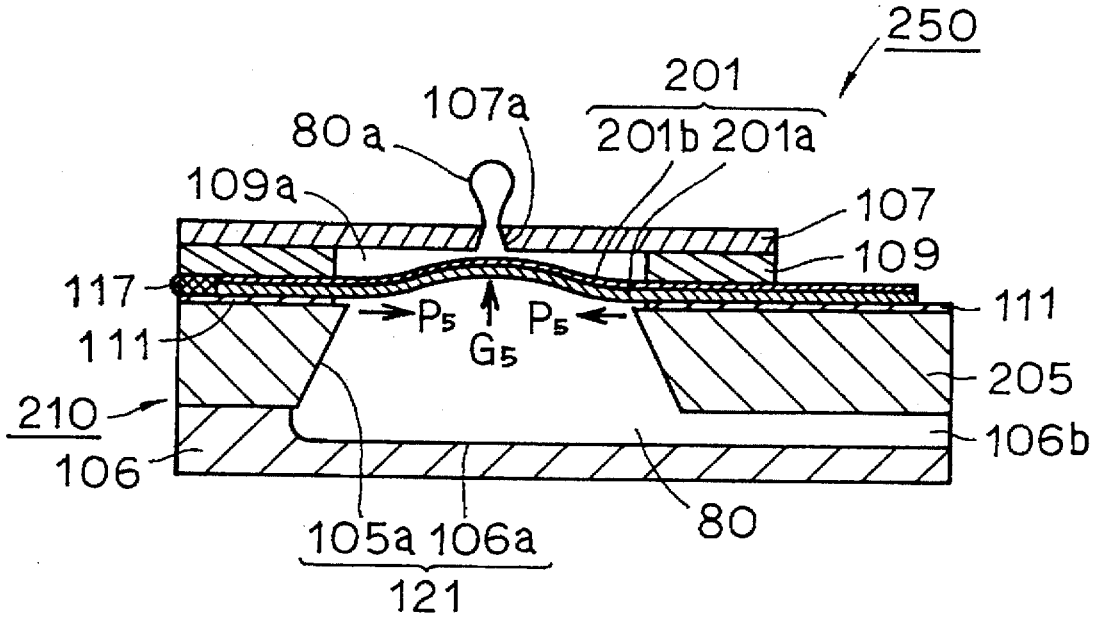
FIG. 31 is a sectional view of the ink jet head according to the fourth embodiment of the present invention showing an operating state thereof.
Figure 32:
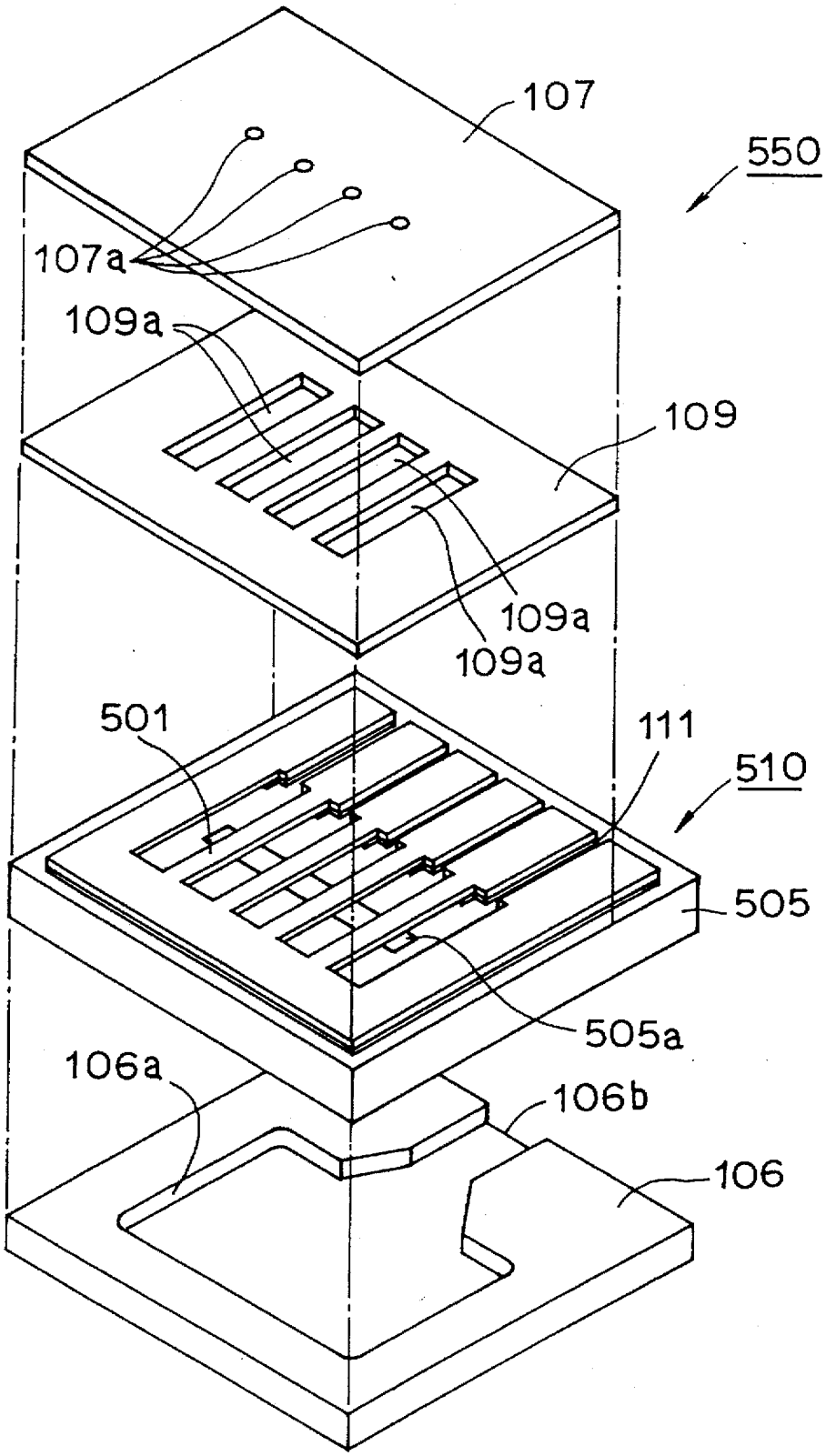
FIG. 32 is an exploded perspective view of an ink jet head according to a fifth embodiment of the present invention.
Figure 33:
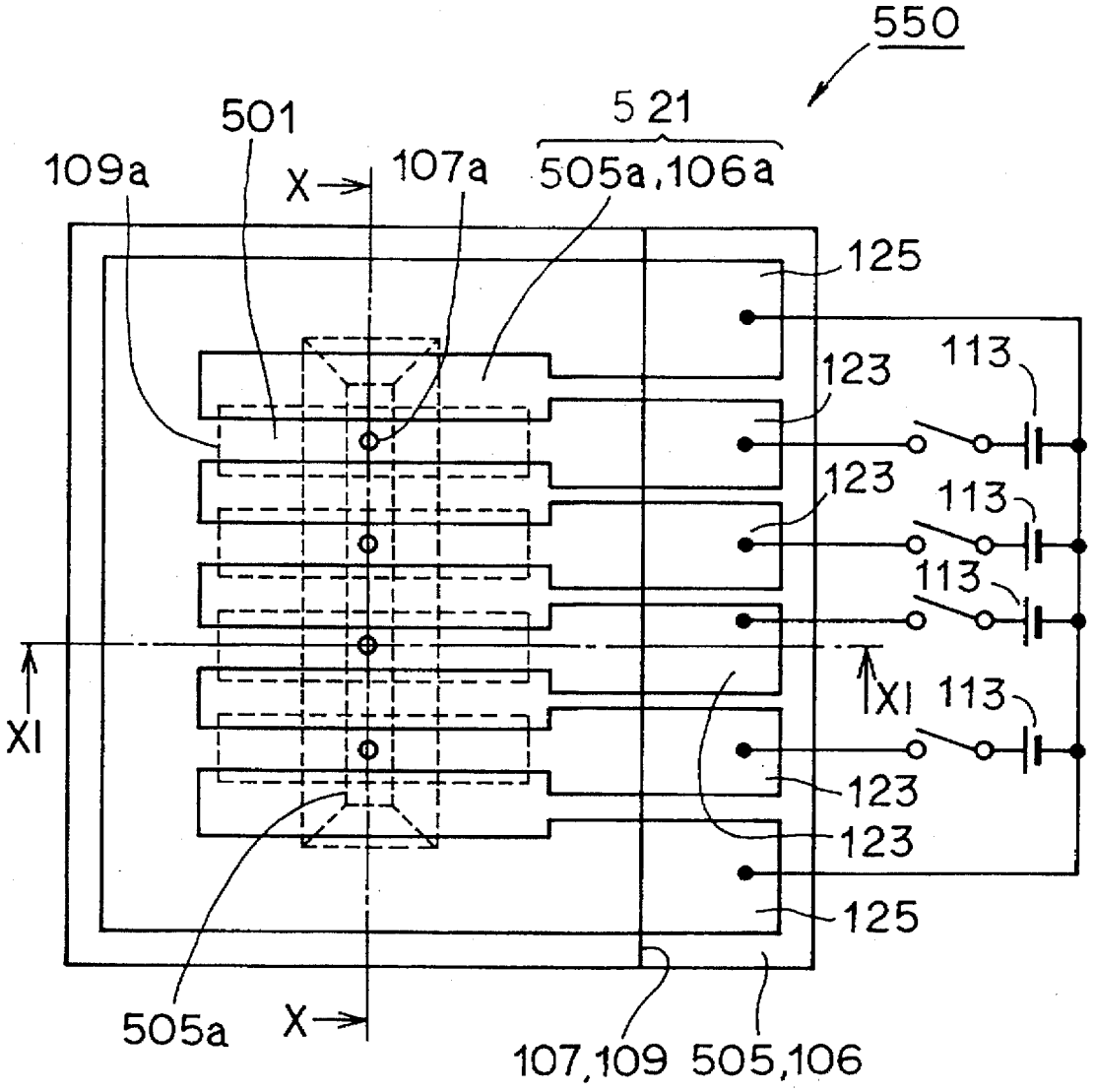
FIG. 33 is a plan view schematically showing a structure of the ink head according to the fifth embodiment of the present invention.
Figure 34:
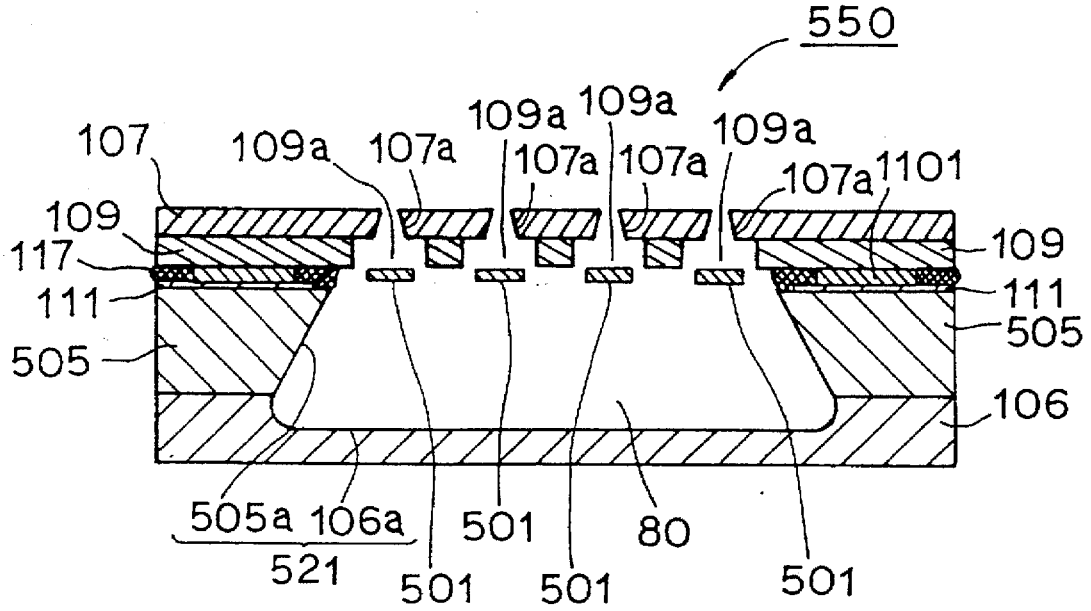
FIGS. 34 and 35 are sectional views of the ink jet head taken along lines X—X and XI—XI, respectively, of FIG. 33.

Buckling structure body 201 has a two layered structure of a thick nickel layer 201*a* and a thin nickel layer 201*b*. The compressive internal stress of thin nickel layer 201*b* is greater than that of thick nickel layer 201*a*. When buckling structure body 201 is heated, buckling occurs in thin film nickel layer 201*b* earlier than thin film nickel layer 201*a*. Therefore, in FIG. 31, the resistance generated in buckling structure body 201 is smaller in the case where the center portion of buckling structure body 201 is displaced towards arrow G5 in comparison with the case of being displaced in a direction opposite to arrow $G_5$. Therefore, buckling structure body 201 of the present embodiment will always be displaced in the same direction (the direction of arrow $G_5$) by heating. Thus, ink jet head 250 can be prevented from operating erroneously.

Ink jet head 250 of the present embodiment provides effects similar to those of the third embodiment.

The present invention is not limited to ink jet head 250 of the present embodiment where buckling structure body 201 has a two layered structure, and a structure of a single layer or more than two layers may be used.

Although nickel is used for both layers of thick and thin film layers 201*a* and 201*b* in buckling structure body 201, different materials may be layered instead.

The present invention is not limited to the electroplating method used as the means for adding internal stress in buckling structure body 201, and any method as long as an internal stress is applied may be used.

Embodiment 5

Referring to FIGS. 32–35, a nozzle plate 107 includes a plurality of nozzle orifices 107*a*, 107*a*, . . . as described above. Cavity 109 includes openings 109*a*, 109*a*, corresponding to nozzle orifices 107*a*, 107*a*, . . . . Each opening 109*a* serves as a pressure chamber of the ink jet head. A concave portion 505*a* for forming an ink chamber 521 is provided at one face of a substrate 505. This concave portion 505*a* serves as an ink flow path 505*a*. The inclination angle θ is set to 54.7° as will be described afterwards. A buckling structure body 501 is formed by photolithography at the other face of substrate 505 with an insulative member 111 therebetween. Buckling structure body 501 has a plurality of strips corresponding to nozzle orifices 107*a*, 107*a*, . . . , and electrodes 501*a* and 501*b* provided appropriately.

Although electrodes 501*a* and 501*b* are provided at either side of the nozzle orifice train in the present embodiment, the electrodes may be provided only at one side of the train of nozzle orifices. A casing 106 is fixed at the other side face of substrate 505 to form an ink chamber 521. Ink is provided to ink chamber 521 from an ink tank via an ink feed inlet 106*b*.

Buckling structure body 501 is formed of, for example, nickel. Substrate 505 is formed of a material having a thermal conductivity of at least $70W \cdot m^{-1} \cdot K^{-1}$ such as single crystalline silicon.

The space around buckling structure body 501 is appropriately filled with a filling agent 117.

Figure 35:
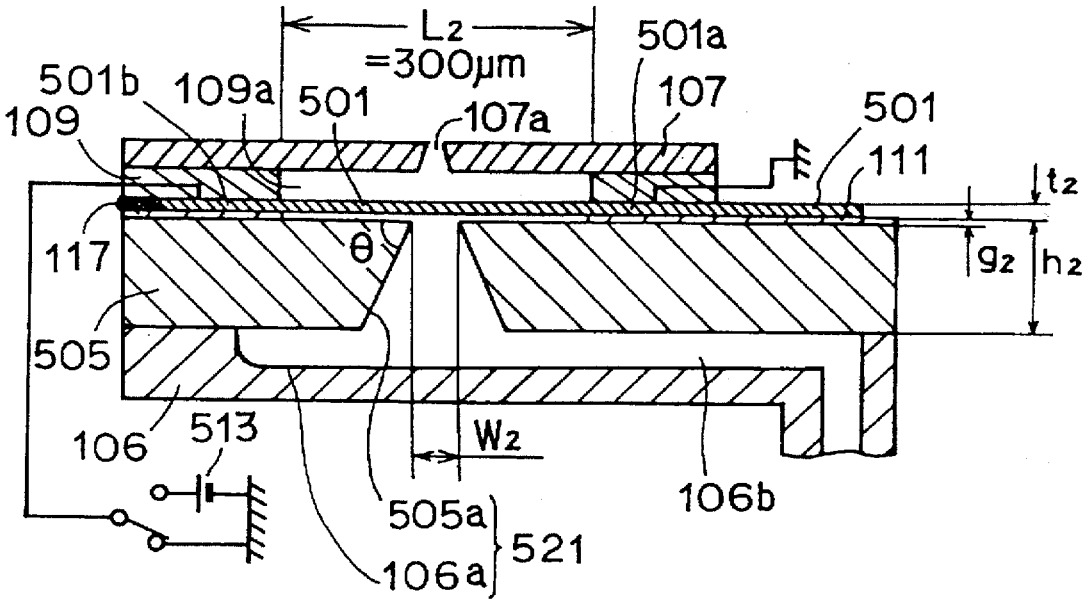
Figure 36:
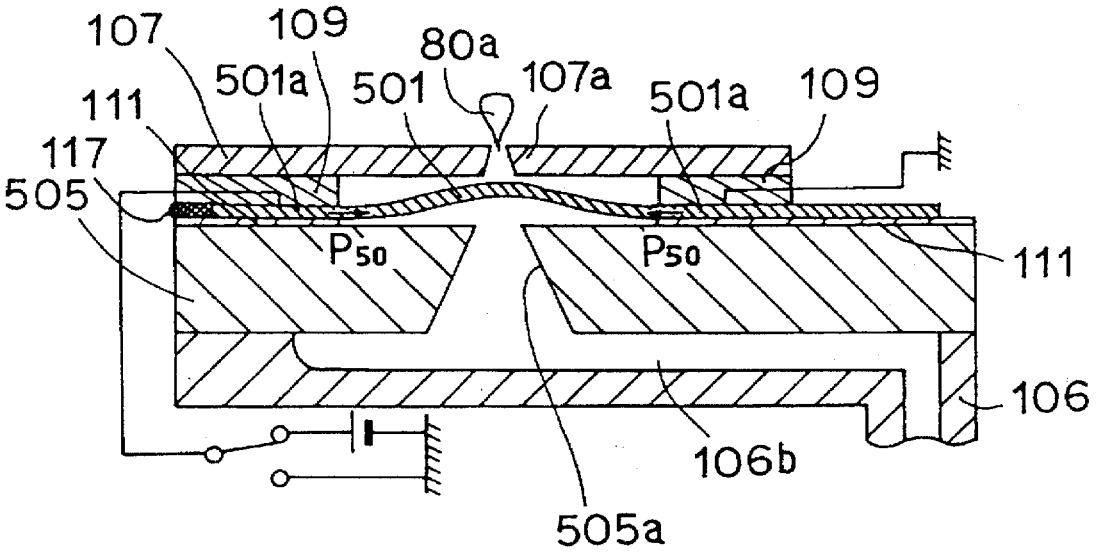
FIG. 36 is a sectional view of the ink jet head according to the fifth embodiment of the present invention showing an operating state thereof.

The operation of ink jet head 550 of the present invention will be described hereinafter. Referring to FIG. 35, current flows via electrodes 501*a* and 501*b*, whereby buckling structure body 501 tries to induce thermal expansion as a result of being heated due to resistance heating. However, expansion deformation cannot be established since both ends of buckling structure body 501 are fixed. A compressive force $P_{50}$ in the arrow direction is generated as shown in FIG. 36. Buckling deformation occurs when compressive force $P_{50}$ exceeds the buckling load, whereby the buckling portion which is not fixed is deformed towards nozzle plate 107. As a result, pressure is propagated towards the ink located between buckling structure body 501 and nozzle plate 107. An ink droplet 80*a* is formed from nozzle orifice 107*a* to be sprayed outwards.

In buckling structure body 501 formed of nickel with a buckling portion of 300 μm in length, 48 μm in width, and 6 μm in thickness, buckling occurs at the temperature of at least 98° C. when the room temperature is 25° C. As buckling structure body 501 is heated to 225° C., buckling structure body 501 is deformed towards nozzle plate 107, whereby an ink droplet 80*a* is formed from nozzle orifice 107*a* to be sprayed outwards. The edge portion of cavity 109 is located slightly outer than the edge portion of insulative member 111 to facilitate the bending of buckling structure body 501 towards the nozzle plate 107 side.

Current towards electrodes 501*a* and 501*b* is suppressed, whereby buckling structure body 501 is cooled down to 98° C., resulting in the standby state shown in FIG. 35.

The time period starting from the application of current to electrodes 501*a* and 501*b* until the occurrence of thermal expansion by buckling structure body 501 being heated to 225° C. by resistance heating (rise response speed: Tr) and the time period starting from the disconnection of current of electrodes 501*a* and 501*b* until the return to a standby state of buckling structure body 501 being cooled down to 98° C. (decay response speed: Td) can be calculated by simulation on the basis of a thermal conduction equation.

Figure 37:
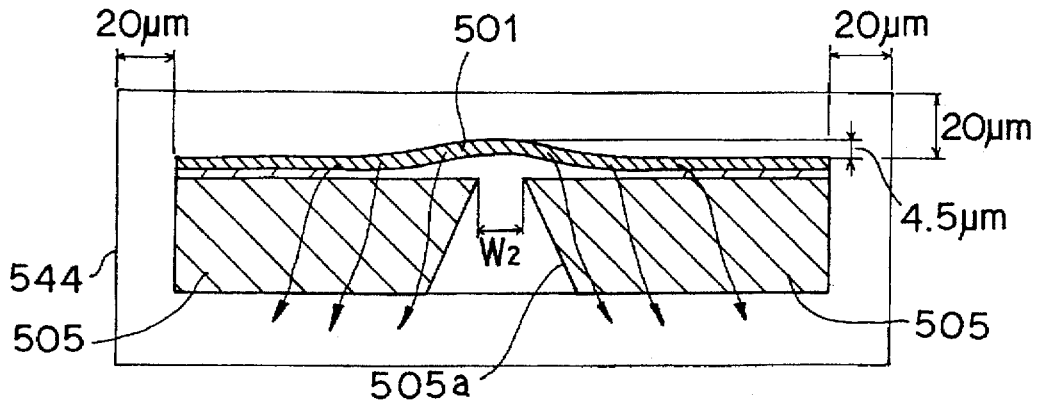
FIG. 37 is a diagram for describing the flow of heat generated by the buckling structure body.

Referring to FIG. 37, buckling structure body 501 is deformed by 9 μm towards nozzle plate 107 when buckling structure body 501 is heated to 225° C. as the boundary condition. Therefore, simulation was carried out according to a structure of buckling structure body 501 deformed by the average value of 4.5 μm. Then, buckling structure body 501 and substrate 505 are placed in a vessel 544 greater by 20 μm than the outer dimension of buckling structure body 501 and substrate 501. Vessel 544 is filled with ink. The distance between the surface of the buckling structure body 501 and the surface of the ink liquid is 20 μm. Simulation was carried out on the assumption that the temperature of the inner surface of vessel 544 and the bottom of substrate 505 is held at 25° C. The arrow shows the main flow of heat.

Simulation carried out with respect to the change in rise response speed (Tr) and the decay response speed (Td) over appropriate variations in the thickness $t_2$(μm) of buckling structure body 501 shown in FIG. 35, the distance $g_2$(μm) between buckling structure body 501 and substrate 505, the width $W_2$ (μm) of the ink flow path outlet, and the thickness $h_2$(μm) of substrate 505 with the device shown in FIGS. 38–41.

Figure 38:
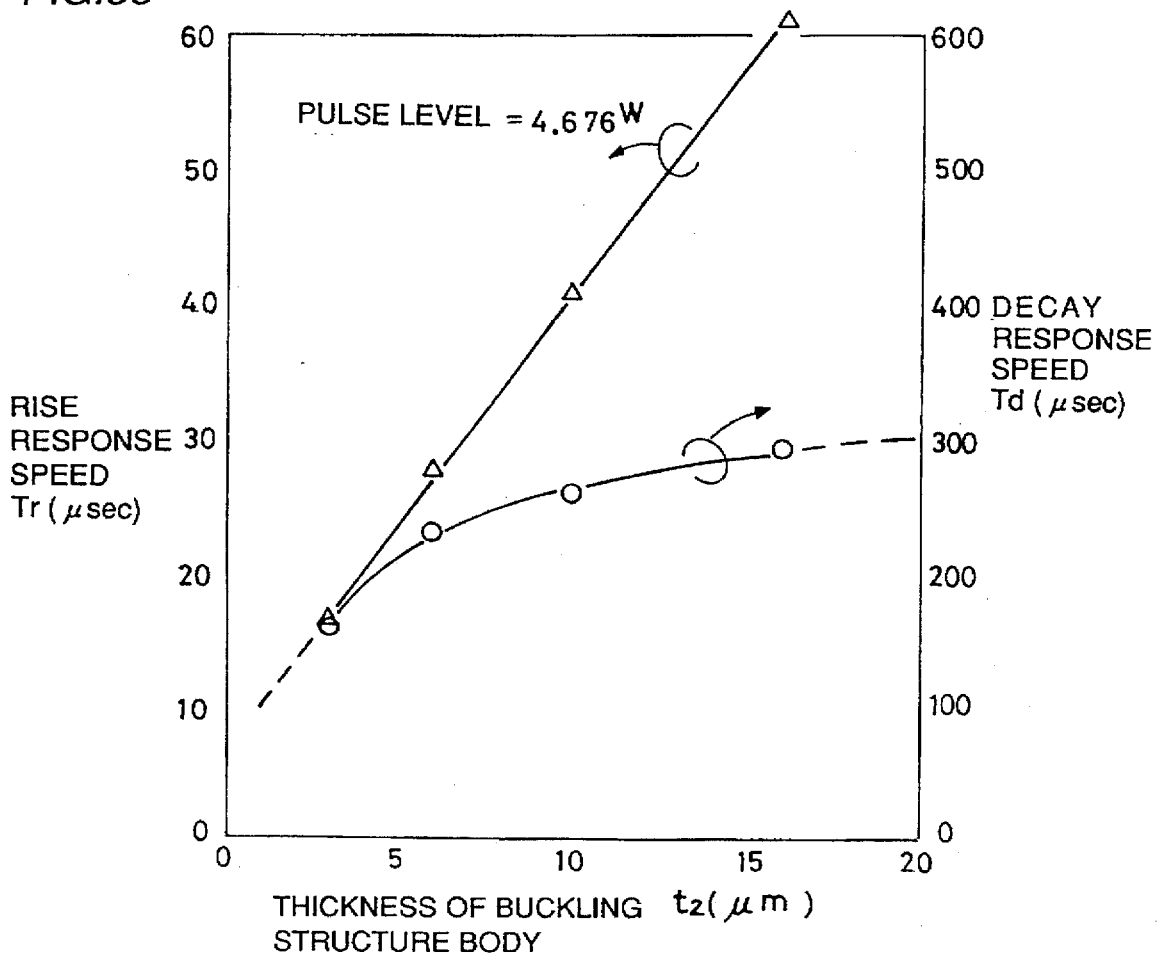
FIG. 38 is a graph showing the relationship between thickness and response speed of a buckling structure body.
Figure 39:
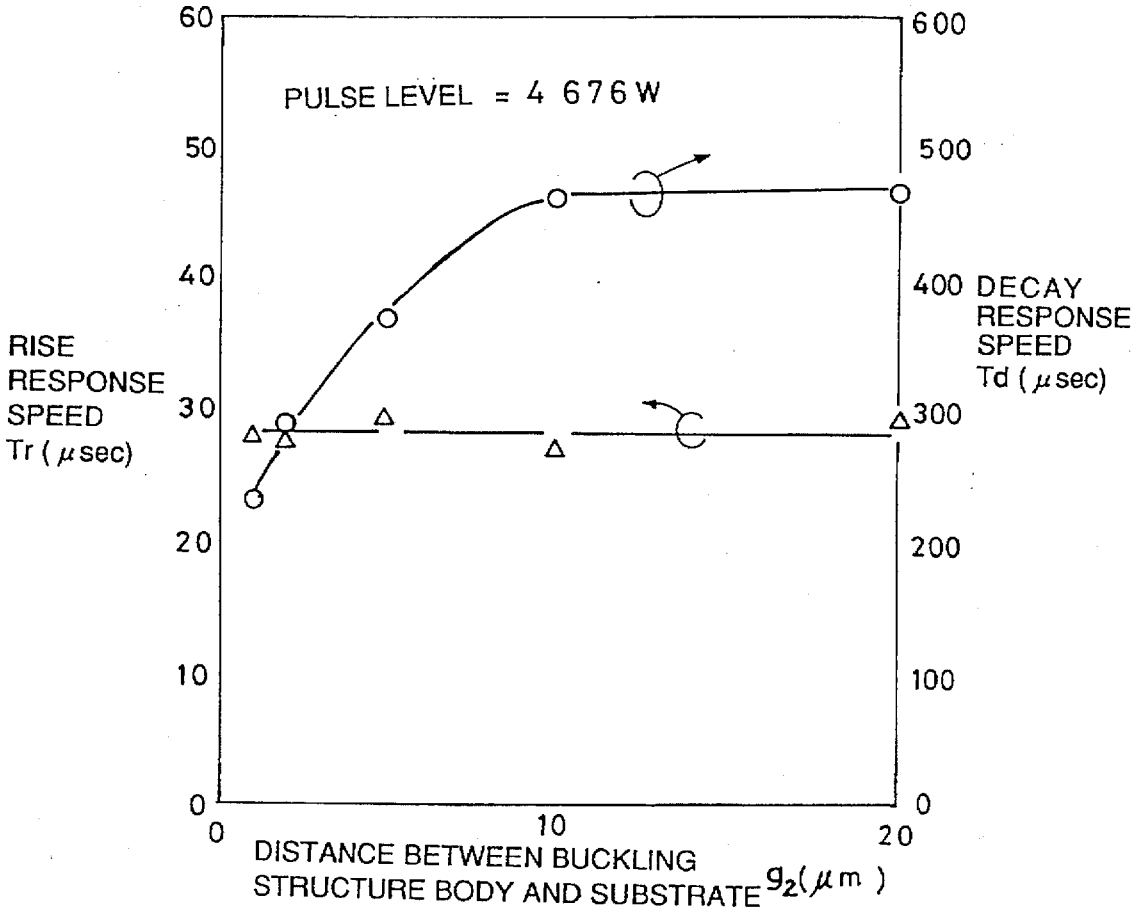
FIG. 39 is a graph showing change in response speed over the distance between a buckling structure body and a substrate.
Figure 40:
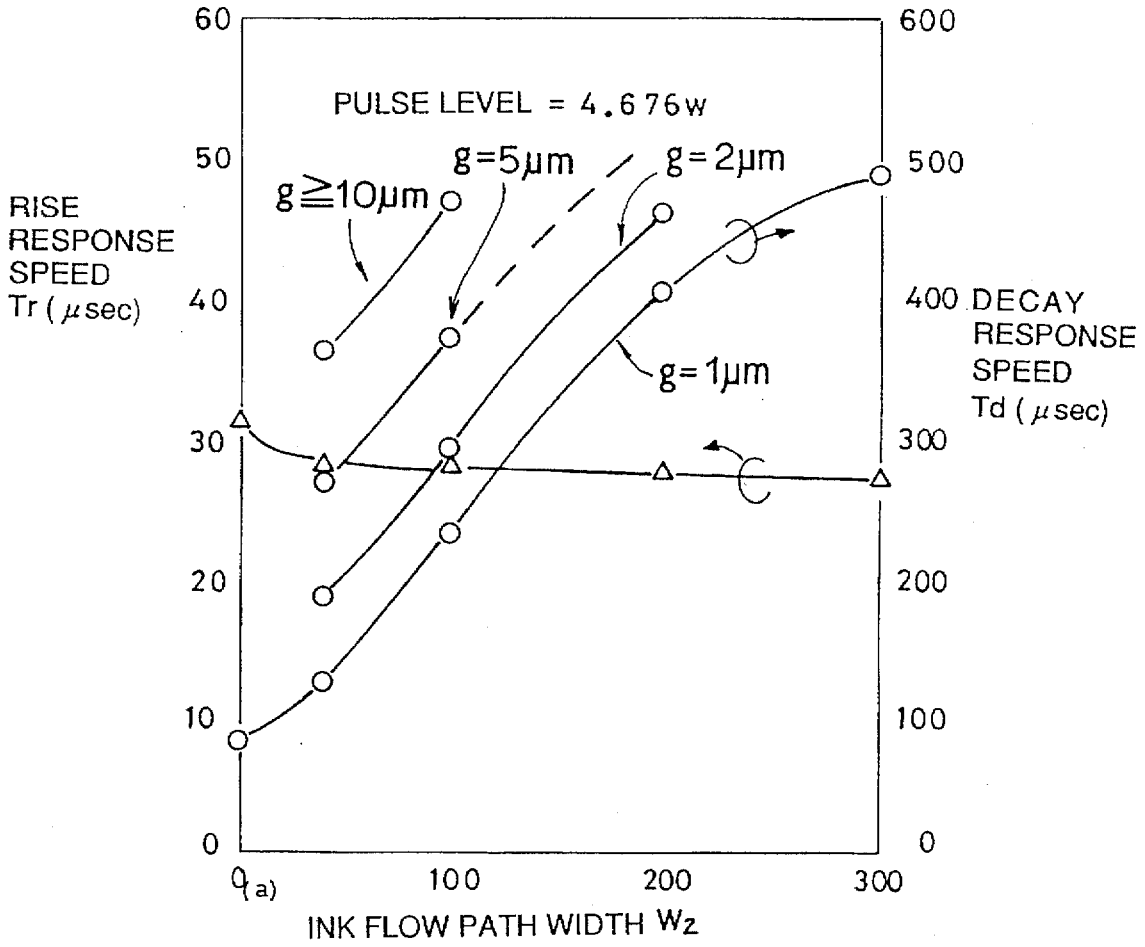
FIG. 40 is graph showing the relationship between the ink flow path width and the response speed over the distance between the buckling structure body and the substrate.

The entire length of buckling structure body 501 is 900 μm, the length $L_2$ of the buckling portion is 300 μm, the thickness $h_2$ of substrate 505 is 500 μm in FIGS. 38–40. The level of the pulse is 4.676 W.

The graph of FIG. 38 shows the relationship of thickness $t_2$ and the rise and decay response speeds Tr (Δ) and Td (o) when the distance $g_2$ is 1 μm and width $W_2$ is 100 μm. Here, the unit of the rise and decay response speed is represented by sec. (seconds: time). The rise and decay response speed is faster as the time is shorter. This applies also for FIGS. 39, 40 and 41.

Both the response speeds of Tr and Td become faster as the thickness $t_2$ of the buckling structure body is reduced. However, when thickness $t_2$ of the buckling structure body is lower than 6 μm, sufficient energy cannot be obtained to spray out an ink outlet 80*a* from the nozzle orifice. Therefore, the lower limit of the optimum thickness $t_2$ of the buckling structure body is 6 μm.

The graph of FIG. 39 shows the relationship between distance $g_2$ and the rise and decay response speeds Tr(Δ) and Td (o) when the thickness $t_2$ is 6 μm and the width $W_2$ is 100 μm. Although the rise response speed Tr is not greatly affected by the distance $g_2$ between the buckling structure body and the substrate, the decay response speed Td becomes faster as the distance $g_2$ is reduced. It is therefore necessary to set the distance $g_2$ to not more than 5 μm in driving the head at, for example, 2.5 kHz. By setting distance $g_2$ to not more than 1 μm, the head can be driven at 3.8 kHz.

The graph of FIG. 40 shows the dependence of the rise and decay response speeds Tr (Δ) and Td (o) upon the ink flow path width $W_2$ when the thickness $t_2$ is 6 μm and the distance $g_2$ varied. Although the rise response speed Tr is not greatly affected by ink flow path width $W_2$, the decay response speed Td becomes faster as the ink flow path width $W_2$ is reduced. This applies to the distance between any buckling structure body and a substrate. It is therefore necessary to set the distance $g_2$ between the buckling structure body and the substrate to not more than 10 μm with an ink flow path width $W_2$ not more than 40 μm when the head is driven at, for example, 2.5 kHz. If the ink flow path width $W_2$ is set to not more than 100 μm, i.e. the length $L_2$ of the buckling portion of the buckling structure body is set to not more than ⅓ of 300 μm, the distance $g_2$ between the buckling structure body and the substrate must be set below 5 μm at 2.5 kHz. Although not shown, the head can be driven at 3.8 kHz by setting the ink flow path width $W_2$ to not more than 40 μm and the distance $g_2$ to not more than 5 μm.

Figure 41:
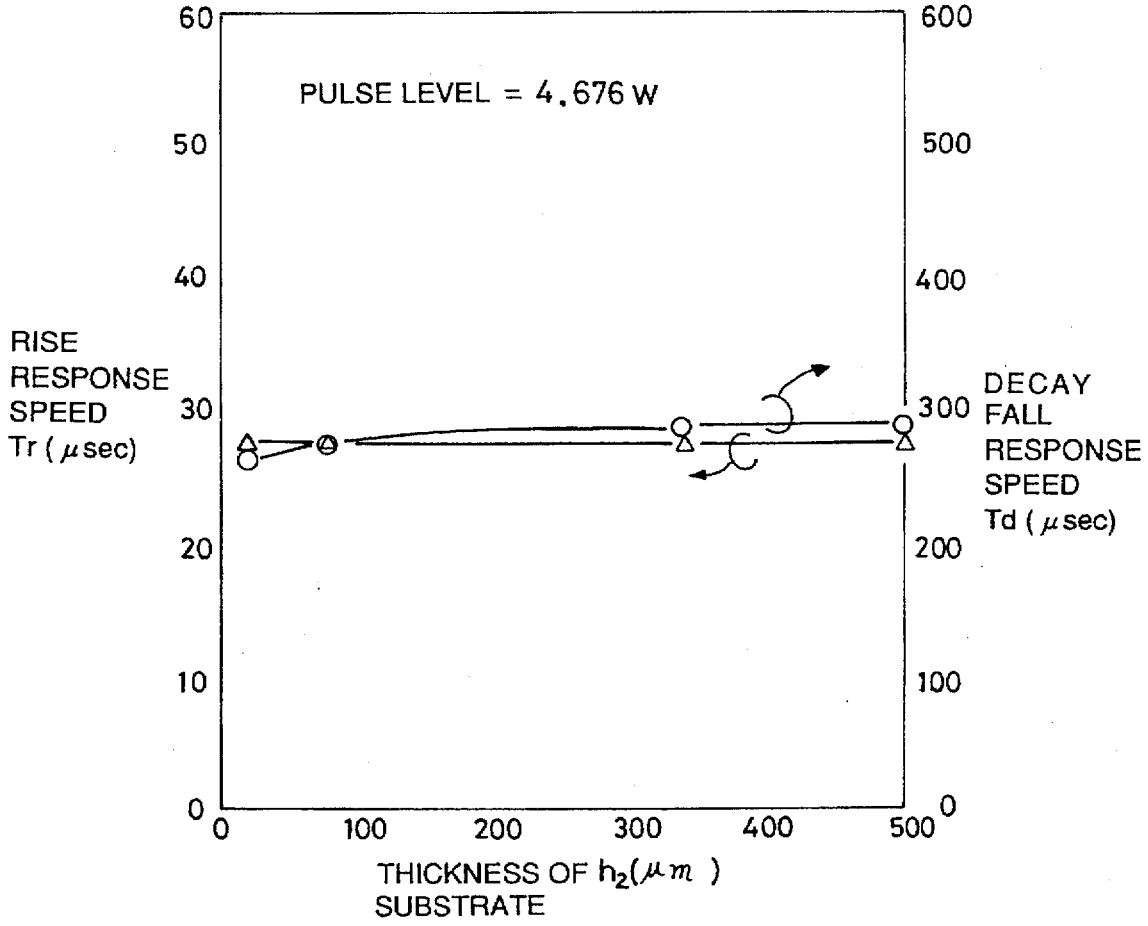
FIG. 41 is a graph showing the relationship between the thickness of the substrate and response speed.

The graph of FIG. 41 shows the relationship between the substrate thickness $h_2$ and the rise and decay response speed Tr (Δ) and Td (o) when the length $L_2$ is 300 μm, the thickness $t_2$ is 6 μm, the distance $g_2$ is 2 μm, and the pulse level is 4.676 W. There is no great change in the rise response speed Tr and the decay response speed Td when the thickness $h_2$ of the substrate is greater than 20 μm. However, the decay response speed Td will become slower if glass, for example, is used instead of single crystalline silicon since glass has a thermal conductivity lower than that of single crystalline silicon. It is therefore necessary to use a material such as single crystalline silicon having a thermal conductivity of at least $70W \cdot m^{-1} \cdot K^{-1}$ for the substrate. If the thickness $h_2$ of the substrate is as described above, a single crystalline silicon plate of 525 μm can be used.

The material of the substrate is not limited to single crystalline silicon, and any material may be used as long as the thermal conductivity is at least $70W \cdot M^{-1} \cdot K^{-1}$.

In order to increase the rise response speed Tr and the decay response speed Td, the distance $g_2$ between buckling structure body 501 and substrate 505, and ink flow path width $W_2$ are to be reduced, and a material having a thermal conductivity of at least $70W \cdot m^{-1} \cdot K^{-1}$ such as single crystalline silicon is used for the substrate.

The graph in FIG. 42A shows the temperature profile of a buckling structure body according to the structure of FIG. 35 with a thickness $t_2$ of 6 μm, a distance $g_2$ between buckling structure body 501 and substrate 501 of 1 μm, an ink flow path width $W_2$ of 40 μm, and a thickness $h_2$ of substrate 505 of 500 μm. The graph of FIG. 42B shows a drive waveform.

It is appreciated from FIG. 42A that the head can be driven at 6 kHz because a rise response speed Tr of 28 μsec and a decay response speed Td of 123 μsec are obtained in which Tr+Td<167 μsec. Furthermore, from FIG. 42B, the effective value W of consumed power per 1 nozzle is:

$$W=4.676(w)\times 28\ (\mu sec)/167\ (\mu sec)=0.784(w)$$

Manufacturing steps of a buckling structure body and a substrate supporting the buckling structure body which are the main members of the present embodiment will be described hereinafter with reference to FIGS. 43A and 43H.

Figure 43A:
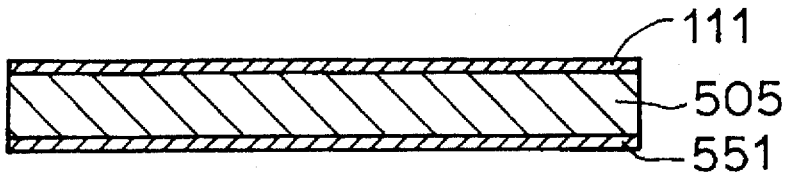

Referring to FIG. 43A, thermal oxide films 111 and 551 are formed to a predetermined thickness, for example, to 1 μm, at both sides of a silicon substrate 505.

Figure 43B:
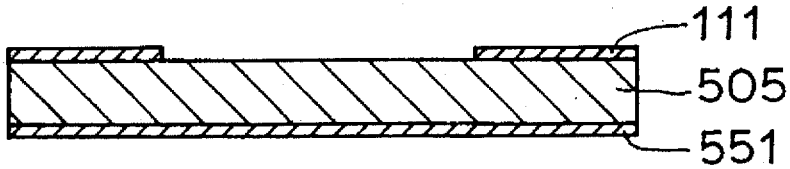

Referring to FIG. 43B, a photoresist is applied on the surface, followed by a patterning step corresponding to the configuration of an insulative member 111 to be formed. Then, thermal oxide film 111 is etched by $CHF_3$.

Figure 43C:
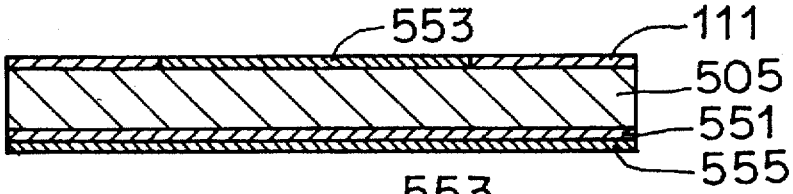

Referring to FIG. 43C, PSG films 553 and 555 are formed by a LPCVD device to a thickness identical to that of thermal oxide film 111, 1 μm, for example, at both faces of substrate 505. Then, a patterning step corresponding to the configuration of a buckling structure body to be formed is carried out with respect to PSG film 553.

Figure 43D:
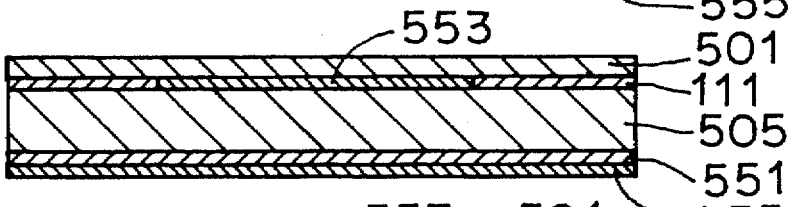

Referring to FIG. 43D, nickel is applied by sputtering on the surface of thermal oxide film 111. Using this thin nickel film as an electrode, nickel coating of a predetermined thickness, for example, 6 μm is carried out by electroplating to form nickel film 501. This electroplating process may include nickel coating using nickel sulfamic acid bath, for example.

Figure 43E:
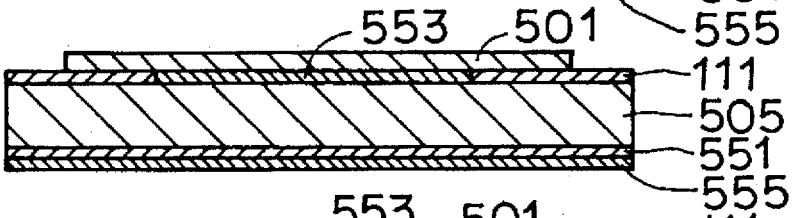

Referring to FIG. 43E, a photoresist is applied to the surface, followed by a patterning step corresponding to the configuration of a buckling structure body to be formed. Then, nickel film 501 is etched with a solution of nitric acid and hydrogen peroxide (for example, $HNO_3H_2O_2:H_2O$= 22:11:67).

Figure 43F:
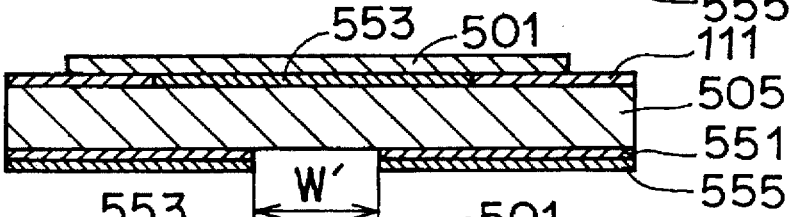

Referring to FIG. 43F, photoresist is applied to the back face, followed by a patterning step corresponding to the configuration of an ink flow path to be formed. Then, PSG film 555 and thermal oxide film 551 are etched with $CHF_3$. Here, if single crystalline silicon of a plane orientation of (100) is used, the (111) inclined plane formed after etching shows an angle of 54.7° to the (100) plane. When the thickness of substrate 505 is $h_2$=525 μm and the ink flow path width is $W_2$=40 μm, the width of the inlet side of the ink flow path is to be set to W'=785 μm by $W_2$+2h/tan54.7°.

Figure 43G:
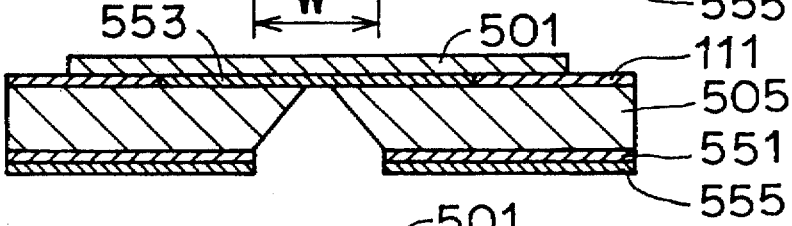

Referring to FIG. 43G, the above-described silicon substrate 505 is immersed in potassium hydroxide solution, whereby the silicon not covered with thermal oxide film 551 and PSG film 555 is removed to result in the formation of an ink flow path.

Figure 43H:
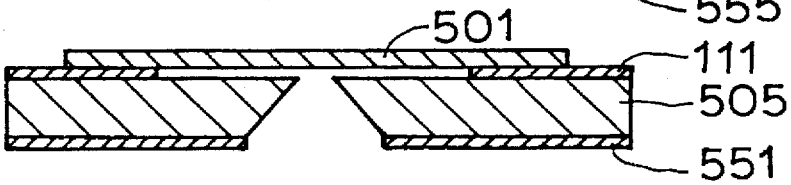

Referring to FIG. 43H, silicon substrate 505 is then immersed in an hydrofluoric acid solution. Because PSG films 553 and 555 have an etching rate 8 times that of thermal oxide films 111 and 551, PSG films 553 and 555 at both sides of silicon substrate 505 are removed. By removal of PSG film 553 which is an inside sacrifice layer, buckling structure 501 will take a spatial three-dimensional structure apart from substrate 505.

Thus, a casing is obtained with a thickness $t_2$ of the buckling structure body of 6 μm, the distance $g_2$ between the buckling structure body and the substrate of 1 μm, and the ink flow path width $w_2$ of 40 μm.

Finally, substrate 510 including nozzle plate 107, cavity 109, and buckling structure body 501 is bonded to ink cover 106 to complete an ink jet head.

Modifications of the structure having heat radiation of the buckling structure body improved will be described hereinafter as Embodiments 6–9.

Embodiment 6

The structure of an ink jet head of the present invention shown in FIG. 44 differs from that of the first embodiment in a casing 625. The opening diameter (width) $W_6$ of an ink flow path 625*c* of casing 625 at the buckling structure body 21 side is set to not more than ⅓ the length $L_6$ of the buckling portion of buckling structure body 21. When the length $L_6$ of the buckling portion is, for example, 300 μm, the opening diameter $W_6$ is not more than 100 μm.

The distance $g_6$ between buckling structure body 21 and casing 625 is set to not more than 10 μm. In other words, the thickness of the compressive force generation means (insulative member) 23 is set to not more than 10 μm.

Casing 625 is formed of a material having a thermal conductivity of at least $70W \cdot m^{-1} \cdot K^{-1}$ such as single crystalline silicon.

The remaining components of the structure are similar to those of the first embodiment, and their description will not be repeated.

The operation is also similar to that of the first embodiment, where buckling structure body 21 is deformed towards nozzle orifice 27*a* as shown in FIG. 45 by buckling, whereby an ink droplet 80*a* is formed by a pressure therefrom.

Because the dimension (distance $g_6$, opening diameter $W_6$) of casing 625 and the material are limited in the ink jet head of the present embodiment, heat radiation of buckling structure body 21 is superior. Even if buckling structure body 21 is heated to a high temperature, rapid radiation is achieved, resulting in superior response of heating. Thus, the present structure is applicable for high speed printing due to its high speed response.

The ink jet head of the present embodiment provides effects similar to those of the first embodiment.

Embodiment 7

An ink jet head 650 of the present embodiment shown in FIG. 46 differs in the structure of a casing 645 in comparison with the second embodiment. The opening diameter (width) $W_7$ of an ink flow path 645*c* of casing 645 at the buckling structure body 21 side is set to not more than ⅓ the length $L_7$ of the buckling portion of buckling structure body 21. When the length $L_7$ of the buckling portion is 300 μm, opening diameter $W_7$ is not more than 100 μm.

The distance $g_6$ between buckling structure body 21 and casing 645 is set to not more than 10 μm. In other words, the thickness of compressive force generation means (insulative member) 43 is set to not more than 10 μm.

Casing 625 is formed of a material having a thermal conductivity of at least $70W \cdot m^{-1} \cdot K^{-1}$ such as single crystalline silicon.

The remaining components of the structure are similar to those of the second embodiment, and their description will not be repeated.

The operation thereof is also similar to that of the second embodiment, where buckling structure body 41 is deformed towards the nozzle orifice 47*a* side by buckling, whereby an ink droplet 80*a* is formed by a pressure therefrom.

Ink jet head 650 of the present invention provides effects similar to those of the second embodiment.

Embodiment 8

An ink jet head 750 according to the present invention shown in FIG. 48 differs in the structure of a casing 710, particularly in the structure of a substrate 705 in comparison with that of the third embodiment. The opening diameter (width) $W_8$ of an ink flow path 705*a* of substrate 705 at the buckling structure body 101 side is set to not more than ⅓ the length $L_8$ of the buckling portion of buckling structure body 101. When the length $L_8$ of the buckling portion is 300 μm, the opening diameter $W_8$ is not more than 100 μm.

The distance $g_8$ between buckling structure body 101 and substrate 705 is set to not more than 10 μm. In other words, the thickness of compressive force generation means (insulative member) 111 is set to not more than 10 μm.

The material of substrate 705 is formed of a material having a thermal conductivity of at least $70 \cdot W \cdot m^{-1} \cdot K^{-1}$ such as single crystalline silicon.

The remaining components of the structure are similar to those of the first embodiment, and their description will not be repeated.

The operation thereof is similar to that of the third embodiment, where buckling structure body 101 is deformed towards nozzle orifice 107*a* as shown in FIG. 49 by buckling. Thus, an ink droplet 80*a* is formed by the pressure therefrom.

Because the dimension of each portion (distance $g_8$, opening diameter $W_8$) and the material of substrate 705 is limited, heat radiation of the heated buckling structure body 101 is superior. Therefore, buckling structure body 101 heated to a high temperature can be cooled rapidly, superior in response by heating. Because the above-described structure is applicable to high speed response, the ink jet head of the present embodiment is suitable for high speed printing.

Ink jet head 750 of the present embodiment provides effects similar to those of the third embodiment.

Embodiment 9

An ink jet head 850 of the present embodiment shown in FIG. 50 differs in the structure of a casing 810, particularly in the structure of a substrate 805, in comparison with the fourth embodiment. The opening diameter (width) $W_9$ of an ink flow path 805*a* of substrate 805 at the buckling structure body 201 side is set to not more than ⅓ the length $L_9$ of the buckling portion of buckling structure body 201. For example, when the length $L_9$ of the buckling portion is set to 300 μm, the opening diameter $W_9$ is not more than 100 μm.

The distance $g_9$ between buckling structure body 201 and substrate 805 is set to not more than 10 μm. In other words, the thickness of compressive force generation means (insulative member) 111 is set to not more than 10 μm.

Substrate 805 is formed of a material having a thermal conductivity of at least $70W \cdot m^{-1} \cdot K^{-1}$ such as single crystalline silicon.

The other components of the structure are similar to those of the fourth embodiment, and their description will not be repeated.

The operation is also similar to that of the fourth embodiment, where buckling structure body 201 is deformed towards nozzle orifice 107*a* as shown in FIG. 51 by buckling, whereby an ink droplet 80*a* is formed by pressure therefrom.

Because the dimension of each portion (distance $g_9$, opening diameter $W_9$) and the material of substrate 805 are limited in ink jet head 850 of the present embodiment, the heat radiation of the heated buckling structure body 201 is superior. Even if buckling structure body 201 is heated to a high temperature, rapid radiation is possible. Thus, heat response is superior. Because the above-described structure can correspond to high speed response, the ink jet head of the present embodiment is suitable for high speed printing.

Ink jet head 850 of the present invention provides effects similar to those of the fourth embodiment.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet head applying pressure to ink liquid filled in the interior thereof for discharging an ink droplet outwards from said interior, comprising:

a nozzle plate including a nozzle orifice, a vessel including an ink flow path communicating with said nozzle orifice, a buckling structure body having a center portion located between said nozzle orifice and said ink flow path and having opposing ends, said opposing ends supported by being sandwiched between said nozzle plate and said vessel, and compression means for applying a compressive force inward of said buckling structure body, wherein said buckling structure body is buckled by a compressive force applied by said compression means to have said center portion deformed towards said nozzle orifice.

2. The ink jet head according to claim 1, wherein a distance between said buckling structure body and said vessel is not more than 10 μm, a width of said ink flow path is not more than ⅓ the length of a buckling portion of said buckling structure body at the ink flow path located closest to said buckling structure body, and said vessel includes a material having a thermal conductivity of at least $70W \cdot m^{-1} \cdot K^{-1}$.

3. The ink jet head according to claim 1, wherein said compression means comprises a power source for applying voltage to said buckling structure body.

4. The ink jet head according to claim 1, wherein said buckling structure body comprises a first layer and a second layer in a layered manner, wherein said second layer is located closer to said nozzle orifice than said first layer, and includes a material having a coefficient of thermal expansion greater than a coefficient of thermal expansion of said first layer.

5. An ink jet head applying pressure to ink liquid filled in the interior for discharging said ink liquid outwards from said interior, comprising:

a nozzle plate including a nozzle orifice, a vessel including an ink flow path communicating with said nozzle orifice, a buckling structure body having a center portion located between said nozzle orifice and said ink flow path, a surface facing said nozzle orifice, a back face at a rear side of said surface, and opposing ends, said opposing ends supported to said vessel at said back face, and compression means applying a compressive stress inwards of said buckling structure body, wherein said buckling structure body is buckled by a compressive stress applied by said compression means to have said center portion deformed towards said nozzle orifice.

6. The ink jet head according to claim 5, wherein a distance between said buckling structure body and said vessel is not more than 10 μm, a width of said ink flow path is not more than ⅓ the length of a buckling portion of said buckling structure body closest to said buckling structure body, said vessel includes a material having a thermal conductivity of at least $70W \cdot m^{-1} \cdot K^{-1}$.

7. The ink jet head according to claim 5, wherein said compression means comprises a power source for applying voltage to said buckling structure body.

8. The ink jet head according to claim 5, wherein said compression means comprises a piezoelectric element and a power source for applying voltage to said piezoelectric element, wherein said piezoelectric element is attached to said back face of said buckling structure body, and said buckling structure body is supported to said vessel via said piezoelectric element.

9. An ink jet head applying pressure to ink liquid filled in the interior for discharging said ink liquid outwards from said interior, comprising:

a nozzle plate including a nozzle orifice, a substrate including an ink flow path communicating with said nozzle orifice, a buckling structure body having a center portion located between said nozzle orifice and said ink flow path and having opposing ends, said opposing ends supported to at least said substrate, and compression means for applying a compressive stress inward of said buckling structure body by heating, wherein said buckling structure body is buckled by a compressive stress applied by said compression means to have the center portion of said buckling structure body deformed towards said nozzle orifice, wherein a distance between said buckling structure body and said substrate is not more than 10 μm, wherein a width of said ink flow path is not more than ⅓ a length of a buckling portion of said buckling structure body at the ink flow path located closest to said buckling structure body, wherein said substrate includes a material having a thermal conductivity of at least $70W \cdot m^{-1} \cdot K^{-1}$.

10. The ink jet head according to claim 9, wherein said substrate comprises a material of single crystalline silicon.

11. A method of manufacturing an ink jet head applying pressure to ink liquid filled in the interior for discharging said ink liquid outwards from said interior, comprising the steps of:

forming a bucking structure body with opposing ends on a main surface of a vessel, having the opposing ends supported to said main surface of said vessel, and forming an ink flow path piercing said vessel, and having an opening facing a center portion of said buckling structure body, forming a nozzle plate including a nozzle orifice, and coupling said nozzle plate to said vessel and said buckling structure body so that said both ends of said buckling structure body are supported by being sandwiched by said vessel and said nozzle plate, and said center portion of said buckling structure body is located between said nozzle orifice and said ink flow path.

12. A method of manufacturing an ink jet head applying pressure to ink liquid filled in the interior for discharging said ink liquid outwards from said interior, comprising the steps of:

preparing a substrate of a material having a thermal conductivity of at least $70W \cdot m^{-1} \cdot K^{-1}$.

forming a buckling structure body with opposing ends so that the ends are supported to a main surface of said substrate, and a distance to the main surface of said substrate is not more than 10 μm, and forming an ink flow path piercing said substrate, and having an opening facing a center portion of said buckling structure body, so that an opening diameter of said ink flow path is not more than ⅓ a length of a buckling portion of said buckling structure body at the ink flow path located closest to said buckling structure body, forming a nozzle plate including a nozzle orifice, and coupling said nozzle plate to said substrate so that said center portion of said buckling structure body is located between said nozzle orifice and said ink flow path.

13. The method of manufacturing an ink jet head according to claim 12, wherein said step of forming said buckling structure body having both ends supported to a main surface of said substrate comprises the steps of forming a sacrifice layer on said main face of said substrate, forming a layer which becomes said buckling structure body on said sacrificing layer, and removing said sacrifice layer by etching.

* * * * *